US012320132B2

(12) United States Patent
Baker et al.

(10) Patent No.: US 12,320,132 B2
(45) Date of Patent: Jun. 3, 2025

(54) TILE LEVELING SYSTEM

(71) Applicant: Kaolino O Kalani Richard Baker, Koloa, HI (US)

(72) Inventors: Kaolino O Kalani Richard Baker, Kailua Kona, HI (US); Paul Trpkovski, Kailua Kona, HI (US)

(73) Assignee: Kaolino O Kalini Richard Baker, Kailua Kona, HI (US)

( * ) Notice: Subject to any disclaimer, the term of this patent is extended or adjusted under 35 U.S.C. 154(b) by 0 days.

(21) Appl. No.: 18/437,069

(22) Filed: Feb. 8, 2024

(65) Prior Publication Data

US 2024/0301703 A1 Sep. 12, 2024

Related U.S. Application Data

(63) Continuation of application No. 17/349,691, filed on Jun. 16, 2021, now abandoned.

(60) Provisional application No. 63/039,944, filed on Jun. 16, 2020.

(51) Int. Cl.
*E04F 21/18* (2006.01)
*E04F 13/08* (2006.01)

(52) U.S. Cl.
CPC ..... *E04F 21/18* (2013.01); *E04F 13/0885* (2013.01)

(58) Field of Classification Search
CPC ..... E04G 21/163; E04G 21/10; E04F 21/18; E04F 21/22; E04F 21/0092; E04F 13/0885; E04F 15/02482; E04F 15/02476; E04F 15/0247; E04F 15/02464
USPC ..... 52/126.1, 126.3, 126.4, 126.5, 126.6, 52/126.7, 364, 365, 749.11, DIG. 1, 52/DIG. 4
See application file for complete search history.

(56) References Cited

U.S. PATENT DOCUMENTS 1,236,234 A * 8/1917 Troje ..... A63H 33/046 403/DIG. 1
1,519,179 A * 12/1924 Whittaker ..... E04B 5/12 52/480
1,772,708 A * 8/1930 Cole ..... E04G 21/10 52/745.21
3,152,366 A * 10/1964 Mccrory ..... E04B 1/3408 D25/4
3,211,454 A * 10/1965 Bailey ..... A63D 1/04 52/177
3,292,328 A * 12/1966 Darling ..... E05C 19/16 52/471

(Continued)

*Primary Examiner* — Brian E Glessner
*Assistant Examiner* — Adam G Barlow
(74) *Attorney, Agent, or Firm* — Merchant & Gould P.C.

(57) ABSTRACT

The present disclosure provides tools, systems, and methods for leveling and aligning tiles. A tile leveling tool for guiding installation of tiles on an uneven installation surface comprises: an elongated main body extending along a longitudinal axis thereof, from a first end to a second end, wherein the main body further comprises a flat reference side, wherein the reference side has a straight reference edge parallel to the longitudinal axis; and at least one adjustable spacer extending from the main body configured to extend toward the installation surface, wherein the adjustable spacer is configured to adjust a space between the main body and the installation surface to arrange the reference edge straight across the uneven installation surface and to guide the installation of the tiles evenly.

20 Claims, 23 Drawing Sheets

(56) References Cited

U.S. PATENT DOCUMENTS 3,447,279 A * 6/1969 Craft ..... E04F 21/22 52/741.1
3,642,242 A * 2/1972 Danekas ..... B60S 9/02 248/354.4
3,678,645 A * 7/1972 Valdes ..... E04F 21/22 52/749.11
3,801,128 A * 4/1974 Herndon ..... B60S 9/02 280/763.1
3,998,004 A * 12/1976 Ehrlich ..... A63H 33/046 446/92
4,026,086 A * 5/1977 Langley ..... H01F 7/0252 52/592.6
4,245,442 A * 1/1981 Durham ..... E04B 2/821 52/241
4,478,016 A * 10/1984 Allen ..... E04F 21/0015 52/745.15
4,708,362 A * 11/1987 Raetz ..... B60S 9/04 280/763.1
4,892,439 A * 1/1990 Kiefer ..... E01C 23/01 404/118
4,905,953 A * 3/1990 Wilson ..... B60S 9/04 248/352
5,666,769 A * 9/1997 Lundquist ..... E04D 11/007 248/188.4
6,279,282 B1 * 8/2001 Krionidis ..... E04F 21/05 52/365
6,412,185 B1 * 7/2002 Mills ..... E04F 21/20 52/749.11
6,430,824 B1 * 8/2002 Smith ..... E04F 21/00 33/286
7,254,920 B2 * 8/2007 Steele ..... E04F 21/185 33/371
10,070,725 B2 * 9/2018 Nelson ..... A47C 4/028
10,549,960 B2 * 2/2020 Moose ..... B66C 23/36
2010/0139196 A1 * 6/2010 Healy ..... E04F 21/05 52/749.1

* cited by examiner

TILE LEVELING SYSTEM

CROSS-REFERENCE TO RELATED APPLICATION(S)

This application is a continuation of U.S. application Ser. No. 17/349,691, filed Jun. 16, 2021, which claims priority to U.S. Provisional Application No. 63/039,944, filed Jun. 16, 2020, which are hereby incorporated by reference in their entireties. To the extent appropriate a claim of priority is made to each of the above-disclosed applications.

BACKGROUND

Tiles are installed on surfaces such as floors, walls, countertops, and the like. Installers spend a significant amount of time aligning and leveling tiles as the tiles are being placed on an installation surface. Proper alignment and leveling of each tile is important, because if one tile is improperly installed, the error continues in adjacent tiles such that the installed tiles become aesthetically unacceptable, and the tiles need to be re-installed and/or replaced. Replacing or otherwise correcting errors in tile installation is both costly and time-consuming.

In particular, many installation surfaces have a relatively large size and/or defects and imperfections such as dips, ridges, curvatures, out-of-plane or uneven regions. In addition, tiles may be uneven in dimension or varying in size and thickness. Thus, the tiles, if not properly leveled or aligned, will be unevenly installed on the surface out of level or plane. The unleveled tiles installed on a floor surface may additionally cause safety problems. For example, people may trip or fall on the uneven tiles. There is thus a need for a versatile, low-cost, fast, and effective tool for leveling and aligning tiles to be installed on a surface.

SUMMARY

In general terms, this disclosure is directed to tools, systems, and methods for arranging, and/or leveling, and/or aligning tiles. In one possible configuration and by non-limiting example, a tile leveling tool for guiding installation of tiles on an uneven installation surface is disclosed. Various aspects are described in this disclosure, which include, but are not limited to, the following aspects.

One aspect is a tile leveling tool for guiding installation of tiles on an uneven installation surface. In one embodiment, a tile leveling tool comprises an elongated main body extending along a longitudinal axis thereof, from a first end to a second end, wherein the main body further comprises a flat reference side, wherein the reference side has a straight reference edge parallel to the longitudinal axis; and at least one adjustable spacer extending from the main body configured to extend toward the installation surface, wherein the adjustable spacer is configured to adjust a space between the main body and the installation surface to arrange the reference edge straight across the uneven installation surface and to guide the installation of the tiles evenly.

Another aspect is the tile leveling tool, wherein the tile leveling tool further comprises one or more anchors configured to secure the tool on the uneven installation surface.

A further aspect is the tile leveling tool, wherein the tile leveling tool further comprises an interlocking element configured to removably connect the tool to another tool along the longitudinal axis, wherein the connected tools form a track that provides an extended reference side that is co-planar and an extended reference edge that is straight.

Yet another aspect is the tile leveling tool, wherein the main body of the tool has a substantially rectangular cuboid configuration and comprises a front side, a rear side, a top side, a bottom side, a length, a width, and a height, and wherein the reference edge is at least a part of the length of the main body.

Another aspect is the tile leveling tool, wherein the at least one adjustable spacer of the tool comprises: a threaded bolt configured to be removably threaded into the main body through a threaded aperture thereof, wherein the threaded bolt comprises a front end and a rear end, wherein the rear end is configured to extend out of the rear side; and a leveling pad pivotally coupled to the rear end of the threaded bolt at a joining point proximate a center of the leveling pad; wherein the joining point is movable between the rear side of the main body and the uneven installation surface when the threaded bolt moves in the threaded aperture, and wherein the leveling pad is configured to engage with the installation surface.

A further aspect is the tile leveling tool, wherein the main body of the tool further comprises a recess configured to accommodate the leveling pad such that the leveling pad does not extend out of the rear side in a configuration.

Yet another aspect is the tile leveling tool, wherein the at least one adjustable spacer of the tool comprises: a set screw configured to be removably threaded into the main body through a threaded aperture thereof from the front side, wherein the set screw comprises a front end and a rear end, wherein the rear end is configured to extend out of the rear side, an axle pin mounted on the rear side of the main body proximate the threaded aperture, wherein the axle pin is elongated along the width of the main body; a leveling pad comprising a proximal edge and a distal edge, wherein the proximal edge is connected to the axle pin, and wherein the leveling pad is pivotally connected about the axle pin; wherein, the set screw is configured to move rearwardly along the threaded aperture to cause the rear end of the set screw to contact and push the leveling pad at a point proximate the axle pin and to cause the distal edge of the leveling pad to move rearwardly.

Another aspect is the tile leveling tool, wherein the anchor of the tool is a screw adapted to be threaded into the main body through a compatible screw hole thereof from the front side, wherein the screw has a sufficient length and is configured to be threaded into the installation surface to secure the main body.

A further aspect is the tile leveling tool, wherein the interlocking element of the tool comprises a female end and a male end each placed on one of the two opposed ends of the main body, and wherein the female end is configured to mate with the corresponding male end of another tool such that the two tools are interlocked and aligned in the longitudinal axis thereof.

Yet another aspect is the tile leveling tool, wherein the male end of the interlocking element comprises at least one insert pin protruding from the end of the main body, and the female end comprises at least one insert hole corresponding to the at least insert pin, wherein the insert pin and insert hole are compatible in size, position, and orientation.

Another aspect is the tile leveling tool, wherein the tool further comprises an attracting element placed on each of the two opposed ends of the main body, wherein the attracting element is configured to attract a corresponding attracting element placed on another tool. The attracting element can be a pair of magnets or a magnet and a steel washer.

A further aspect of the tile leveling tool, wherein the tool comprises at least one visual leveling indicator placed on the main body.

In another possible configuration and by non-limiting example, a system for leveling and aligning tiles is disclosed. Various aspects are described in this disclosure, which include, but are not limited to, the following aspects.

One aspect is a system for leveling and aligning tiles, wherein the system comprises at least two tile leveling tools described herein.

Another aspect is the system, wherein the system comprises a sliding tool configured to be slid over the reference side of the tool secured on the installation surface and the tiles installed on the installation surface to cause the tiles be to leveled co-planar with the reference side.

A further aspect is the system, wherein at least 2 tile leveling tools are interlocked along the longitudinal axis to form a track, wherein the track comprises an extended reference side that is co-planar and an extended reference edge that is straight.

In further possible configuration and by non-limiting example, a method for arranging tiles on an uneven installation surface is disclosed. Various aspects are described in this disclosure, which include, but are not limited to, the following aspects.

One aspect is a method for arranging tiles on an uneven installation surface, wherein the method comprises: placing the tile leveling tool described herein on or near an uneven installation surface, with a rear side of the tile leveling tool facing the installation surface; adjusting a space between the rear side of the main body of the tile leveling tool and the installation surface by the at least one adjustable spacer of the tile leveling tool to arrange the reference edge straight across the uneven installation surface and to guide the installation of the tiles evenly; anchoring the tile leveling tool to the installation surface; and arranging tiles on the installation surface such that at least some of the tiles are aligned along the reference edge and are positioned co-planar with the reference side.

Another aspect is the method, wherein the method further comprises: connecting a plurality of the tile leveling tool using the interlocking element each thereof to form a track along the longitudinal axis, wherein the track comprises an extended reference side that is co-planar and an extend reference edge that is straight; anchoring the track on the installation surface; and arranging tiles on the installation surface such that at least some of the tiles are aligned along the extended reference edge and are positioned co-planar with the extended reference side.

A further aspect is the method, wherein the method further comprises: forming a plurality of the track, each track comprising an extended reference side and an extended reference edge; orienting the track on the installation surface to define an installation area, wherein the extended reference side of each track are co-planar; anchoring the tracks on the installation surface; and arranging tiles in the installation area such that at least some of the tiles are aligned along the extended reference edges and are positioned co-planar with the extended reference sides.

Yet another aspect is the method, wherein the method further comprises: using a sliding tool to slide over the reference side of the tile leveling tool secured on the installation surface and the tiles installed on the installation surface to cause the tiles leveled co-planar with the reference sides of the tracks.

Another aspect is the method, wherein the method further comprises: applying cement onto the installation surface; and installing the arranged tiles permanently on the installation surface.

The features, functions, and advantages described herein may be achieved independently in various implementations described in the present disclosure or may be combined in yet other implementations, further details of which may be seen with reference to the following description and drawings.

Figure 1:
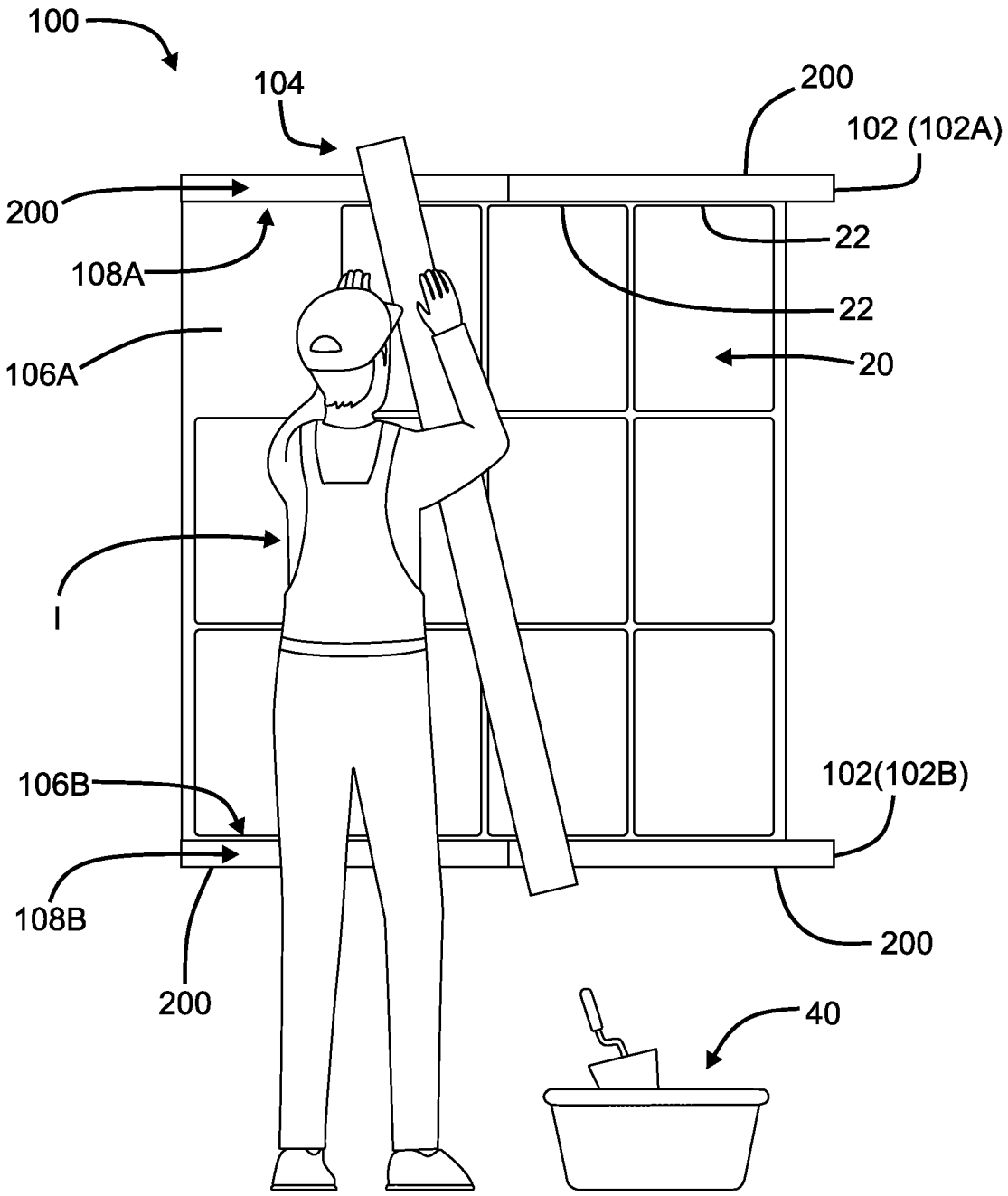
FIG. 1 is a schematic view of an example tile leveling system 100.

Although specific features of various embodiments may be shown in some drawings and not in others, this is for convenience only. Any feature of any drawing may be referenced and/or claimed in combination with any feature of any other drawing. Corresponding reference characters indicate corresponding parts throughout the drawings.

DETAILED DESCRIPTION

Various embodiments will be described in detail with reference to the drawings, wherein like reference numerals represent like parts and assemblies. Reference to various embodiments does not limit the scope of the claims attached hereto. Additionally, any examples set forth in this specification are not intended to be limiting and merely set forth some of the many possible embodiments for the appended claims.

The present disclosure relates to tools, systems, and methods that can be used to arrange tiles to be installed on an installation surface, guide installation of tiles, level and align tiles, such that the tiles can be installed on the installation surface properly to provide a finished tile surface that is flat, even, smooth, in-plane, durable, safe, and long-lasting.

FIG. 1 is a schematic view of an example tile leveling system 100. In this example, the tile leveling system 100 includes a plurality of tile leveling tools 200. In some embodiments, two or more tools 200 can be arranged to form one or more tracks 102. In the illustrated example, the tile leveling system 100 includes two tracks 102A and 102B. In some embodiments, the tile leveling system 100 further includes a sliding tool 104. In the illustrated example, the track 102A comprises an extended reference edge 106A and an extended reference side 108A, and the track 102B comprises an extended reference edge 106B and an extended reference side 108B. Also shown in FIG. 1 are tiles 20, an installation surface 30, and additional tools 40, as well as an installer (I).

In the example shown in FIG. 1, an installer (I) is using the tile leveling system 100 to level and align tiles 20 to be installed on an installation surface 30. In the illustrated example, the two tracks 102A and 102B are positioned parallel to one another and secured on the installation surface 30. The two tracks 102A and 102B form an installation area defined by the extended reference edges 106A and 106B across the installation surface 30. The installer (I) can use the tile leveling system 100 to arrange the tiles 20 in the installation area to allow tile edges 22 of at least some of the tiles 20 be aligned along the extended reference edge 106A and/or 106B, and positioned co-planar with the extended reference sides 108A and 108B. In the illustrated example, the installer (I) may further use the sliding tool 104 to simultaneously slide over the tiles 20 and the extended reference sides 108A and 108B to level the tiles 20 and provide a finished tile surface that is flat, even, and in plane with the extended reference sides 108A and 108B. In the example, the installer may use additional installation tools 40 to install the tiles 20 on the installation surface 30. The additional installation tools 40 may include mortar or cement, tile spacer, mortar applicator, or other tools known in the field.

Figure 2:
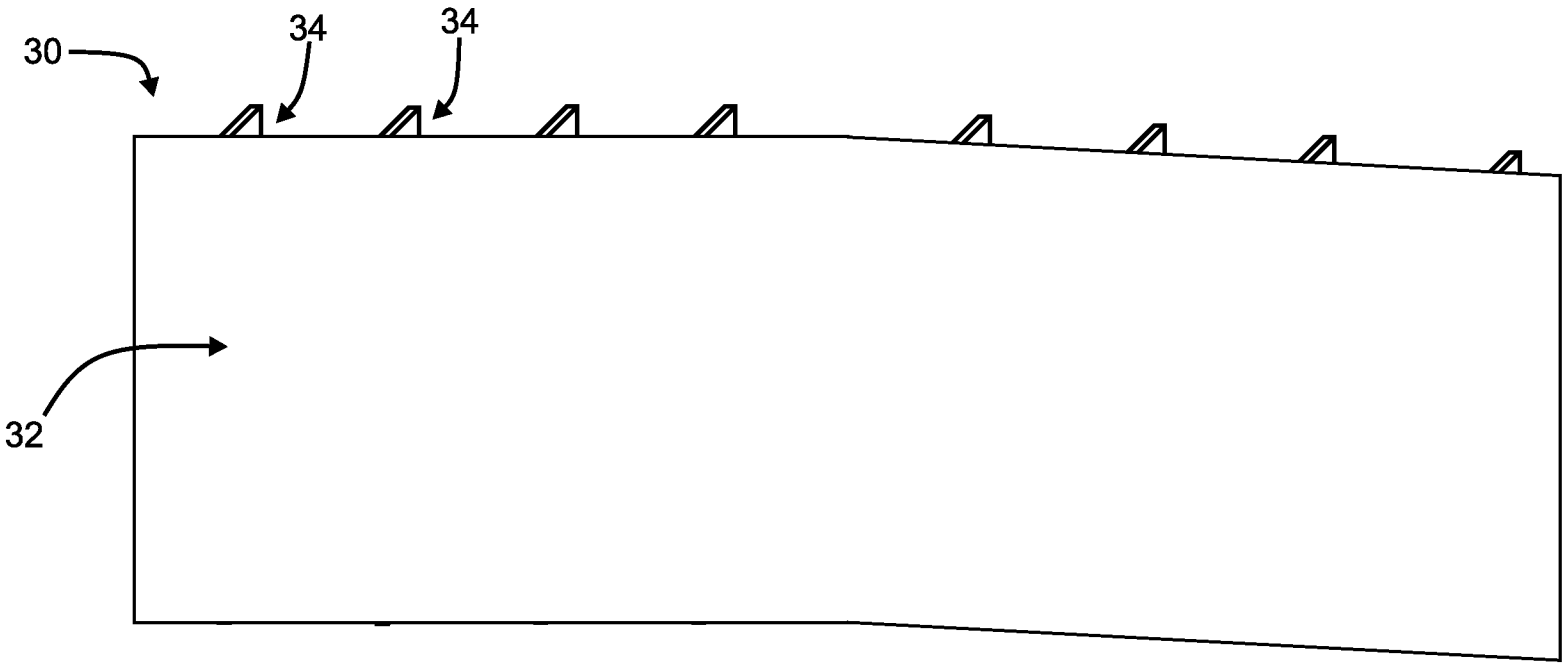
FIG. 2 is a front perspective view of an example installation surface 30.
Figure 3:
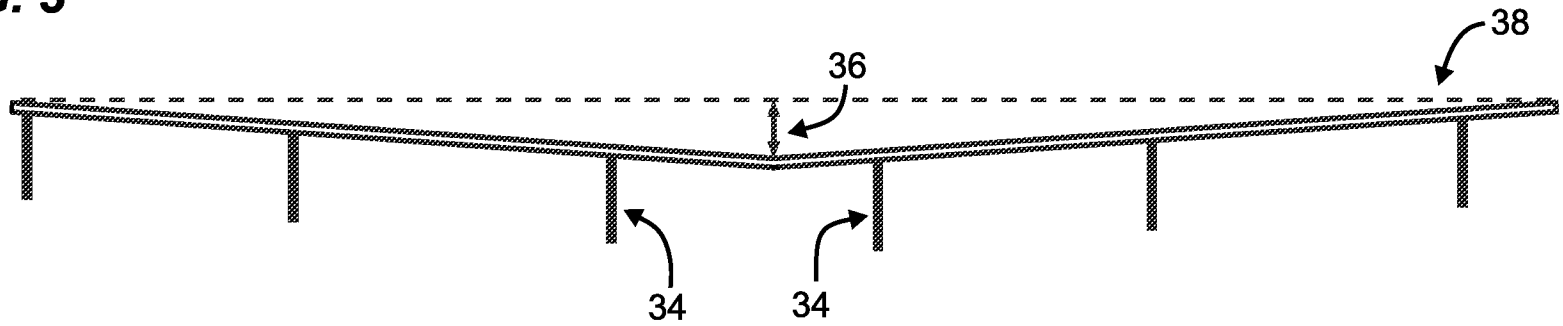
FIG. 3 is a top view of the example installation surface according to FIG. 2.

FIGS. 2 and 3 illustrate an example installation surface 30. FIG. 2 is a front perspective view of the example 30. FIG. 3 is a top view of the example of FIG. 2. As illustrated in the example, the installation surface 30 is in the form of a stud wall 32 and supported by a plurality of studs 34. Other non-limiting examples of the installation surface 30 include a floor, a painted surface, an interior or exterior surface of a building, stairs or steps, or a furniture surface. The installation surface 30 may be unfinished, finished, semi-finished, painted, or stained. The installation surface 30 may be a surface substantially vertical to the ground level, or a surface substantially parallel to the ground level, or a surface forming any angle with the ground level. The installation surface 30 may be composed of sheetrock, wood, stone, metal, ceramic, glass, plastic, or other natural or construction materials.

In some embodiments, the installation surface 30 is an uneven installation surface and includes at least one defect or imperfection. Non-limiting examples of the defect or imperfect include a dip, a ridge, a curved region, a concave or convex region, an out-of-plane region, an uneven area, a textured or rough area. As illustrated in FIG. 3, the installation surface 30 includes an uneven region or a dip 36 that is deviated from a level plane 38. The size of the dip 36 approximated by the maximal deviation from the level plane 38 can be in a range from about 0 to about 1 inch, or from about 0 to about 0.8 inch, or from about 0 to about 0.6 inch, or from about 0 to about 0.5 inch. In some embodiments, the installation surface 30 comprises a plurality of uneven regions or dips 36 across the entire installation surface 30.

Figure 4:
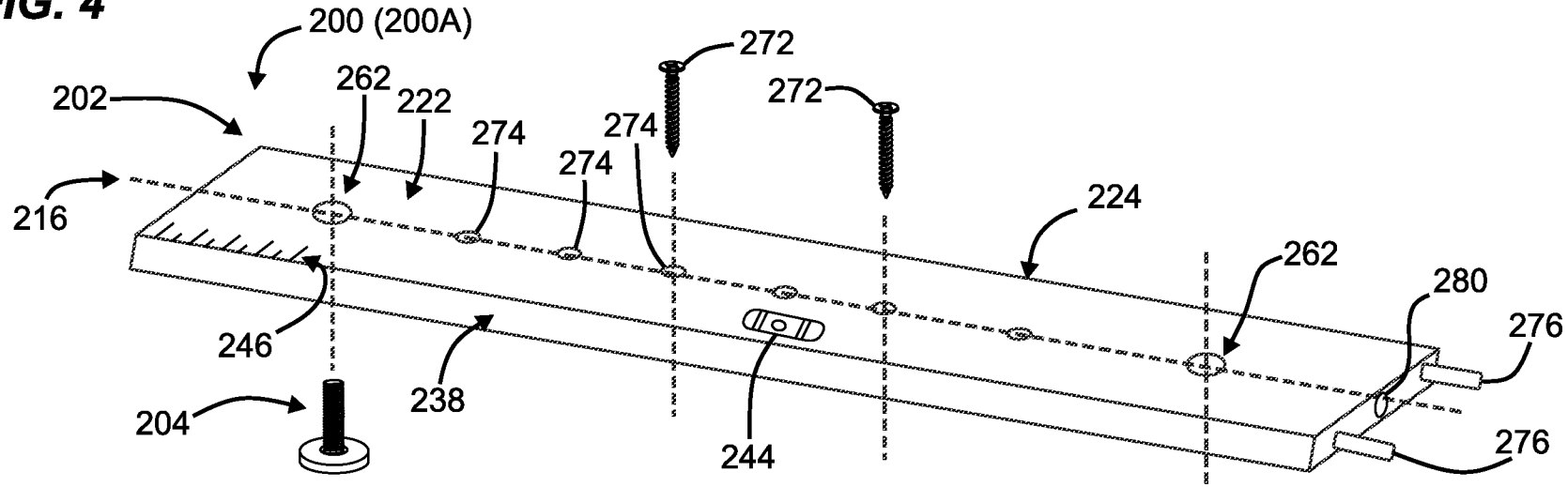
FIG. 4 is an exploded view of one example of the tile leveling tool 200 (200A), in accordance with various embodiments of the present disclosure.
Figure 5:
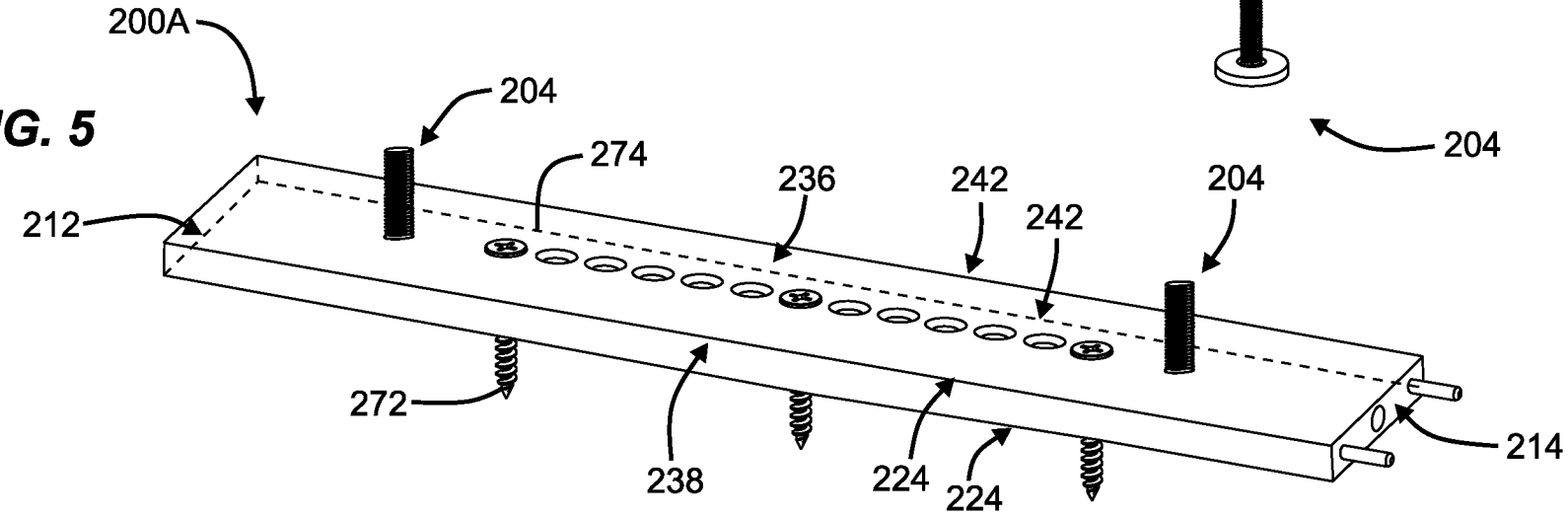
FIG. 5 is a perspective view of an assembled configuration of the tile leveling tool 200A according to FIG. 4.
Figure 6:
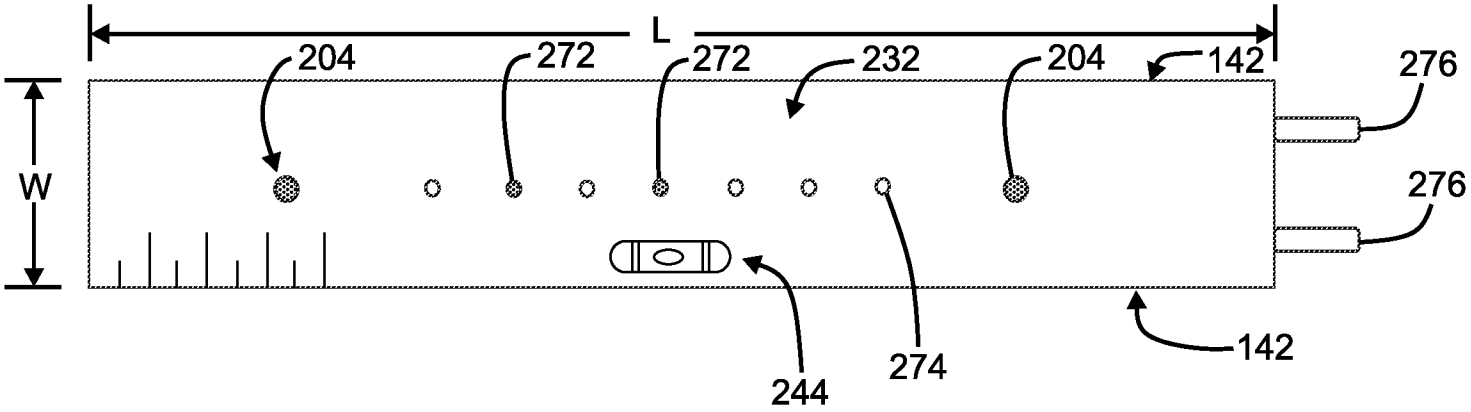
FIG. 6 is a front view of the example tile leveling tool 200A.
Figure 7:
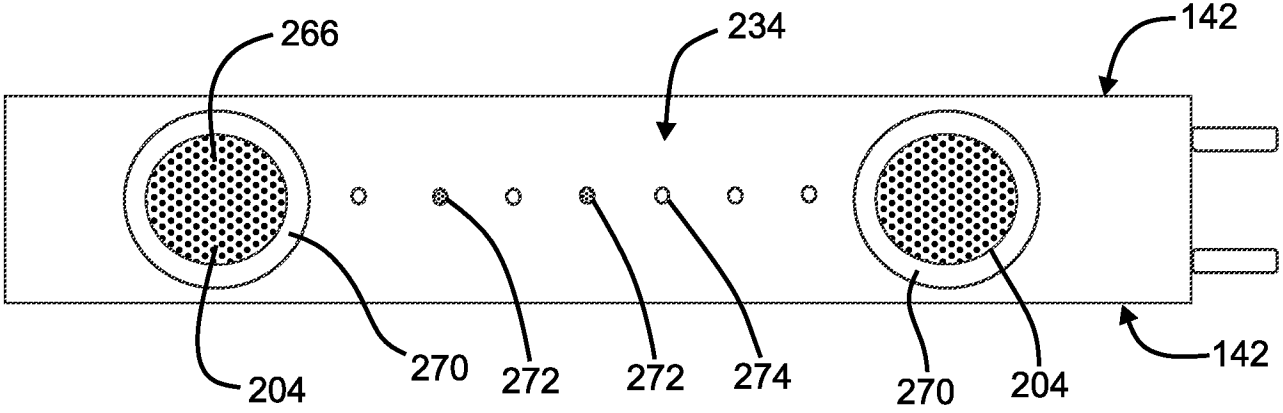
FIG. 7 is a bottom view of the example tile leveling tool 200A.
Figure 9:
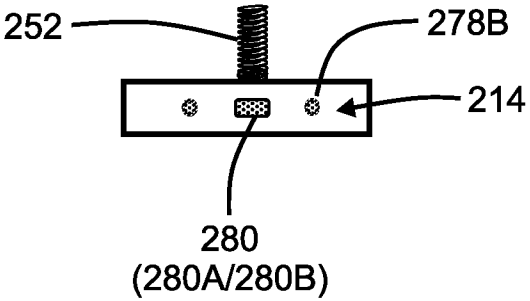
FIG. 9 is an end view of the second end of the example tile leveling tool 200A.
Figure 12:
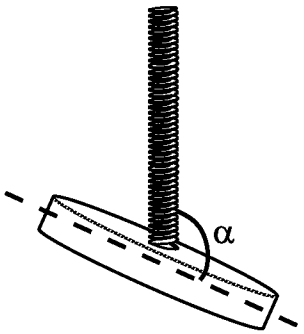
FIG. 12 is a perspective view of yet another configuration of the example adjustable spacer of FIG. 10.
Figure 11:
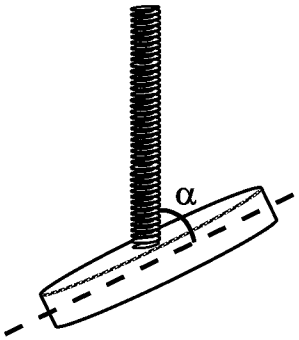
FIG. 11 is a perspective view of another configuration of the example adjustable spacer of FIG. 10.
Figure 8:
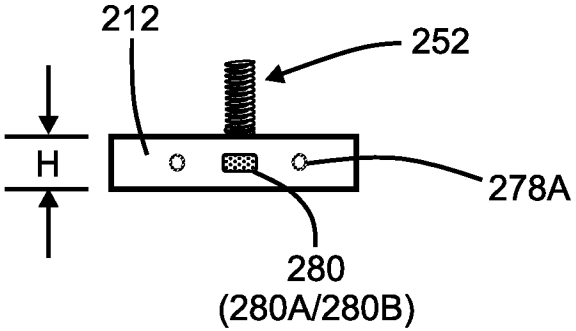
FIG. 8 is an end view of the first end of the example tile leveling tool 200A.
Figure 10:
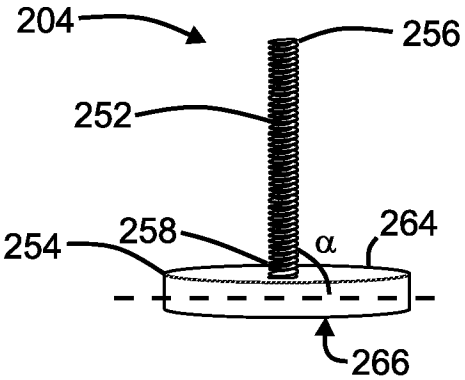
FIG. 10 is a perspective view of one configuration of an example adjustable spacer 204 of the tile leveling tool 200A.
Figure 13:
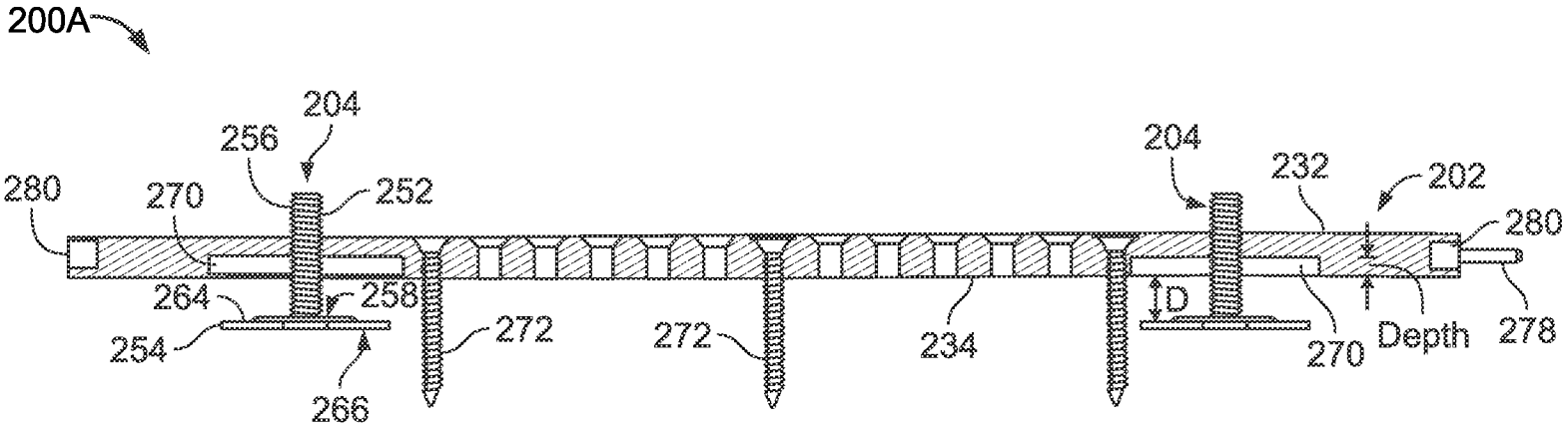
FIG. 13 is a cross-sectional view of one configuration of the example tile leveling tool 200A.
Figure 14:
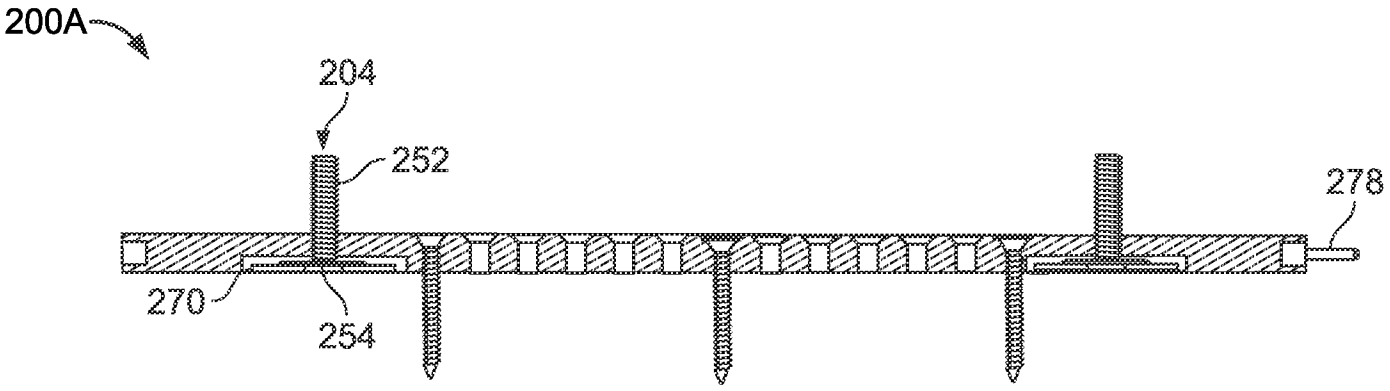
FIG. 14 is a cross-sectional view of another configuration of the example tile leveling tool 200A.

Now referring to FIGS. 4-24, exemplary examples of the tile leveling tool 200 (200A or 200B) will be described. FIGS. 4-14 illustrate the tool 200A as one example of the tool 200. FIG. 4 is an exploded view of the tool 200A. FIG. 5 is a perspective view of the assembled tool 200A. FIG. 6 is a front view of the assembled tool 200A. FIG. 7 is a bottom view of the assembled tool 200A. FIG. 8 is an end view of the first end of the tool 200A. FIG. 9 is an end view of the second end of the tool 200A. FIGS. 10-12 illustrate various configurations of an example component of the tool 200A. FIGS. 13-14 illustrate cross-sectional views of the tool 200A.

As illustrated in the example, the tool 200A comprises a main body 202 and at least one adjustable spacer 204. As a note, the tool 200A may be composed of various individual components that can be separated apart (FIG. 4). The various components can be assembled to form an integrated tool 200A (FIG. 5) that is ready to use.

As illustrated in the example, the main body 202 has a substantially rectangular cuboid configuration and includes a first end 212, a second end 214, at least one reference side 222, at least one reference edge 224, a front side 232, a rear side 234, a top side 236, a bottom side 238, four longitudinal edges 242, a length (L), a width (W), and a height (H).

The main body 202 can be made of any material that is rigid, durable, impact-resistant, and/or chemical-resistant. Non-limiting examples of the material used for the main body 202 include wood, metal, ceramic, plastic, composite, reinforced material, or engineered material. The main body 202 may optionally have a coating layer disposed on an outer surface thereof. The coating layer may be protective, cleanable, colored, writable, or of other functions.

In the illustrated example, the main body 202 is extended from the first end 212 to the second end 214 along a longitudinal axis 216 thereof. In some embodiments, the reference side 222 is flat or substantially flat and can be a part of any of the front side 232, the rear side 234, the top side 236, and/or the bottom side 238. The reference edge 224 is straight or substantially straight and can be any of the four longitudinal edges 242. The front side 232 is configured to be exposed to an installer when in use. The rear side 234 is configured to face the installation surface when in use. In some embodiments, at least a part of the front side 232 is used as the reference side 222, which provides a reference level plane for an installer to guide tiles leveling and alignment. In some embodiments, the reference edge 224 can be any of the at least one longitudinal edge 242, which provides a guide for an installer to level and align tiles with at least a portion of the reference edge 224.

In some embodiments, the length (L) of the main body 202 is from about 3 inches to about 200 inches, or from about 6 inches to about 100 inches, or from about 9 inches to about 50 inches, or from about 10 inches to about 25 inches, or from about 12 inches to about 18 inches. In some embodiments, the width (W) of the main body 202 is from about 0.5 inch to about 10 inches, or from about 1 inch to about 6 inches, or from about 1 inch to about 4 inches, or from about 2 inches to about 3 inches. In some embodiments, the height (H) of the main body 202 is from about 0.1 inch to about 1 inch, or from about 0.2 inch to about 0.8 inch, or from about 0.3 inch to about 0.6 inch, or from about 0.3 inch to about 0.4 inch.

In some embodiments, the main body further includes a level indicator 244. The level indicator 244 can be placed on either the front side 232, or the top side 236, or both. The level indicator 244 provides a visual guide for an installer to adjust the tool 200A to a leveled position on an installation surface.

In some embodiments, the main body 202 further includes a series of measure indicia 246. Examples of the measure indicia such as marks, ruling indicators, grooves, colored lines. The measure indicia 246 allows an installer to measure size of tiles or monitor spaces between adjacent tiles.

FIGS. 10-12 illustrate an example adjustable spacer 204. In the illustrated example, the adjustable spacer 204 comprises a threaded bolt 252 and a leveling pad 254 that is removably coupled to the threaded bolt 252. The threaded bolt 252 is extended from a front end 256 to a rear end 258. The threaded bolt 252 has a length that is greater than the height (H) of the main body 202.

In the illustrated example, the threaded bolt 252 is configured to be removably threaded into the main body 202 through a threaded aperture 262 thereof. The threaded aperture 262 may be pre-existing and compatible with the threaded bolt 252 in size and orientation. Alternatively, the threaded aperture 262 may be generated in situ when the threaded bolt 252 is threaded into the main body 202.

In one possible configuration as shown in FIGS. 8-9, the front end 256 of the threaded bolt 252 extends out of the front side 232 and faces an installer, and the rear end 258 extends out of the rear side 234 and face an installation surface where tiles are to be installed. Upon actuation, the threaded bolt 252 is threadedly movable in both a frontward and a rearward direction along the height (H) of the main body 202.

In the illustrated example, the leveling pad 254 has a relatively thin configuration and comprises a front surface 264 and a rear surface 266. The leveling pad 254 is pivotally coupled to the rear end 258 of the threaded bolt 252 at a joining point proximate a center of the front surface 264. The leveling pad 254 is pivotable relative to the rear end 258 and can form an angle ($\alpha$) relative to the threaded bolt 252. As illustrated in FIGS. 10-12, the angle ($\alpha$) can be adjustable in a range from about 30 degree to about 150 degree. In one possible configuration shown in FIG. 10, the leveling pad 254 can be perpendicular to the threaded bolt 252 with the angle ($\alpha$) of about 90 degree. In other possible configurations, the angle ($\alpha$) can be about 45 degree (FIG. 11) or about 135 degree (FIG. 12). The leveling pad 254 has a thickness, determined by the average distance from the front surface 264 to the rear surface 266, in a range from about 0 to about 0.25 inch, or from about 0.05 to about 0.20 inch, or from about 0.1 to about 0.15 inch.

In some embodiments, the main body 202 further comprises a recess 270 on the rear side 234. The recess 270 is configured to accommodate the leveling pad 254 of the adjustable spacer 204. The recess 270 has a depth that is no less than the thickness of the leveling pad 254. In some embodiments, the depth of the recess 270 is in a range from about 0 to about 0.25 inch, or from about 0.05 to about 0.20 inch, or from about 0.1 to about 0.15 inch. In one possible configuration as shown in FIG. 14, the leveling pad 254 can entirely reside in the recess 270 such that the leveling pad 254 does not extend out of the rear side 234.

In operation, an installer can move the threaded bolt 252 to adjust a distance between the rear side 234 of the main body and the leveling pad 254. The distance (D) is adjustable in a range from about 0 to about 1 inch, or from about 0 to about 0.8 inch, or from about 0 to about 0.6 inch, or from about 0 to about 0.5 inch.

In some embodiments, the tool 200A further includes at least one anchor 272. The anchor 272 comprises a fastening mechanism that is configured to removably secure the tool 200A on an installation surface where tiles are to be installed on. In the illustrated example, the anchor 272 is a threaded screw such as a drywall screw that can be threaded into the main body 202 through an aperture 274 from the front side 232. The aperture 274 may be pre-existing and compatible with the anchor 272 in size and orientation. Alternatively, the aperture 274 may be generated in situ when the anchor 272 is threaded into the main body 202. The anchor 272 has a length that is greater than the height (H) of the main body 202 such that the anchor can be threaded through the main body 202 and into an installation surface facing the rear side 234 of the main body 202. When secured onto an installation surface by the anchor 272, the tool 200A can be immobilized and remain a position unchanged until the anchor 272 is detached from the installation surface. In some embodiments, the tool 200A includes a plurality of anchors 272. The plurality of anchors 272 may be aligned along the longitudinal axis 216 approximate a center line of the front side 232 of the main body.

In some embodiments, the tool 200A further includes an interlocking element 278. The interlocking element 278 is configured to removably connect the tool 200A to another tool 200A along the longitudinal axis 216. In the illustrated example, the interlocking element 278 includes a female end 278A and a male end 278B. The female end 278A includes at least one insert hole located on the first end 212. The male end 278B includes at least one insert pin placed on the second end 214. In the illustrated example, the insert pins of the male end 278B protrude from the second end along the longitudinal axis 216. The insert pins of the male end 278B correlate to the insert hole of the female end 278A in size, relative position, and orientation, such that two or more tools 200A can be connected end-to-end along the longitudinal axis 216 to form the track 102.

In some embodiments, the tool 200A further includes at least one attracting element 280. In the illustrated example, the attracting element 280 includes a pair of magnets 280A, or a magnet 280A and a steel washer 280B. In some embodiments, the magnet 280A is placed on each of the first end 212 and the second end 214 of the main body 202. In other embodiments, a magnet 280A is place on the first end 212, and the steel washer 280B is placed on the second end 214. The attracting element 280 of the tool 200A is configured to attract an attracting element 280 of another tool 200A when the two tools 200A are connected and interlocked. The attraction between the attracting elements 280 may further improve the interlocking strength of the connected tools 200A.

Figure 15:
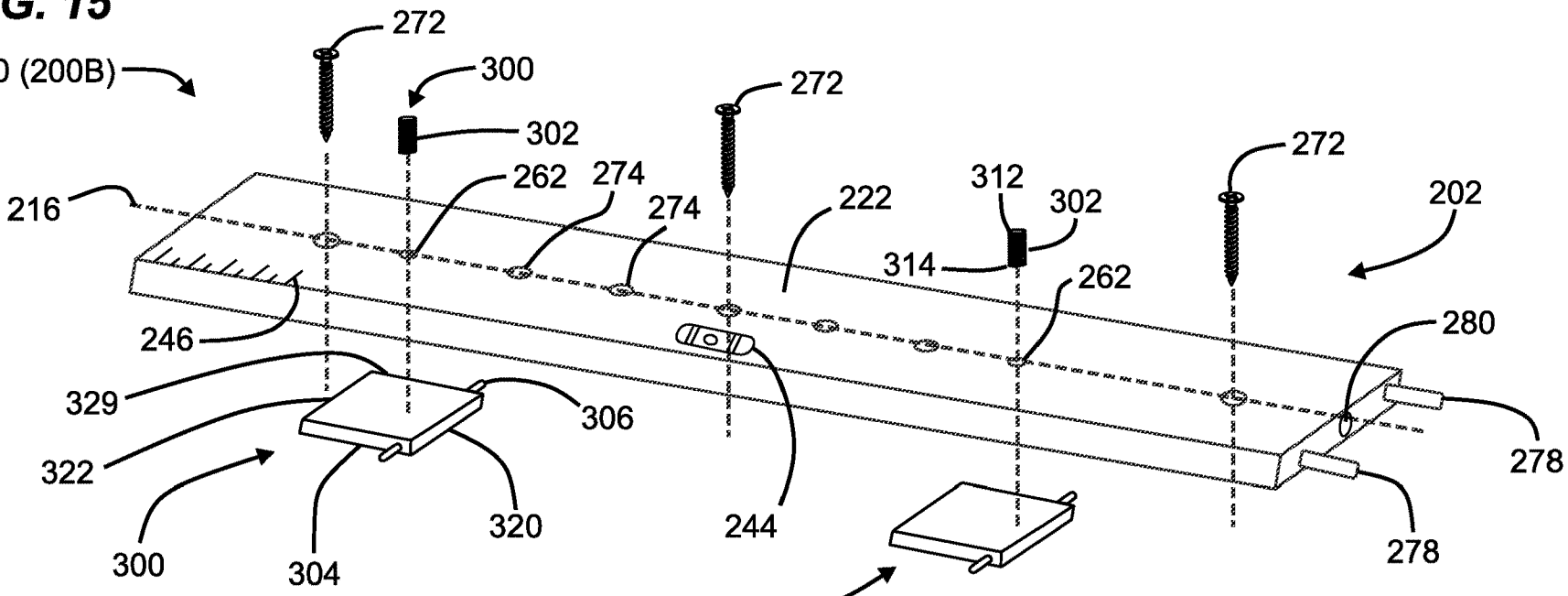
FIG. 15 is an exploded view of another example of the tile leveling tool 200 (200B), in accordance with various embodiments of the present disclosure.
Figure 16:
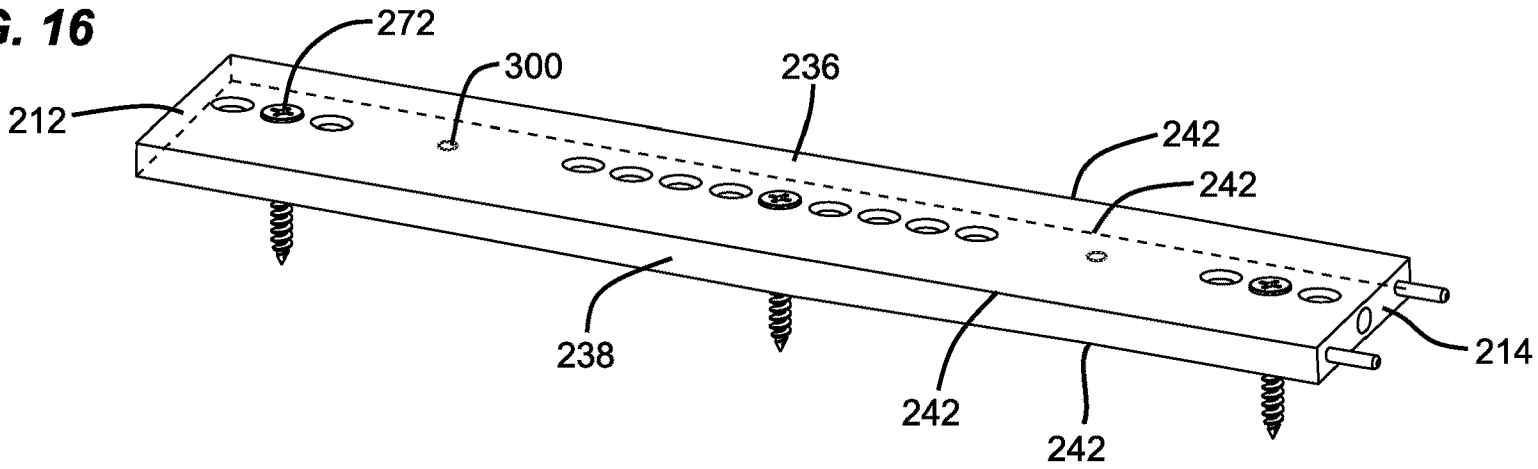
FIG. 16 is a perspective view of an assembled configuration of the tile leveling tool 200B according to FIG. 15.
Figure 17:
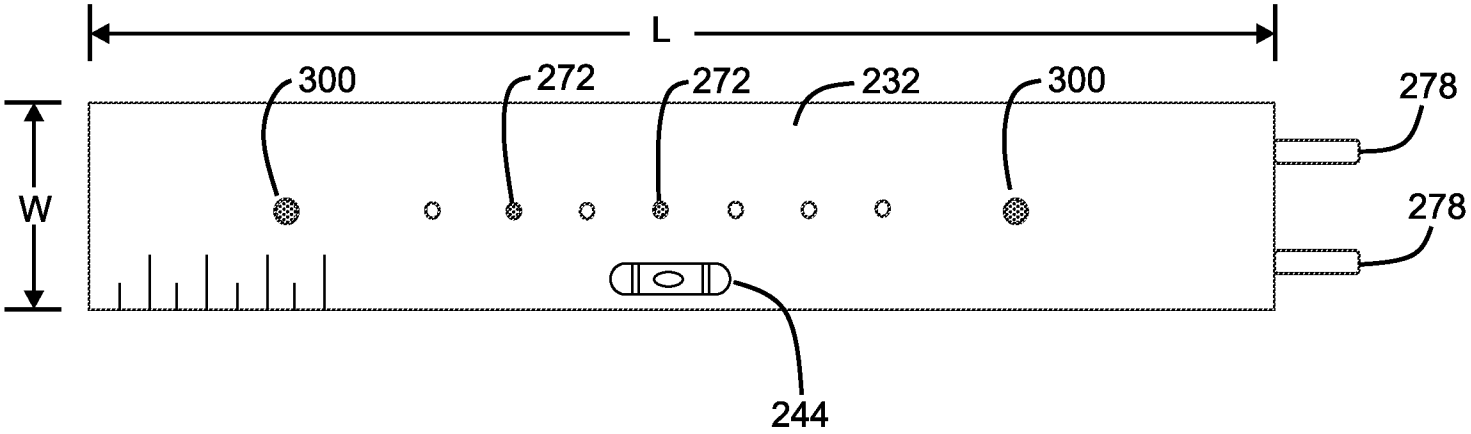
FIG. 17 is a front view of the example tile leveling tool 200B.
Figure 18:
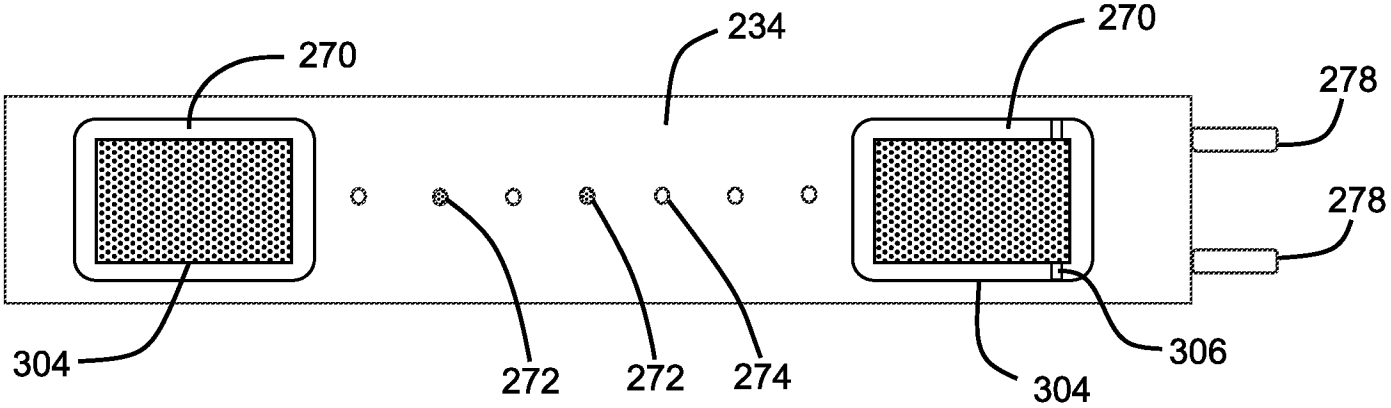
FIG. 18 is a bottom view of the example tile leveling tool 200B.
Figure 19:
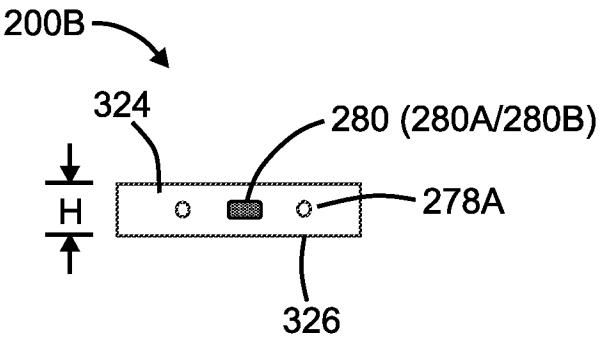
FIG. 19 is an end view of the first end of the example tile leveling tool 200B.
Figure 20:
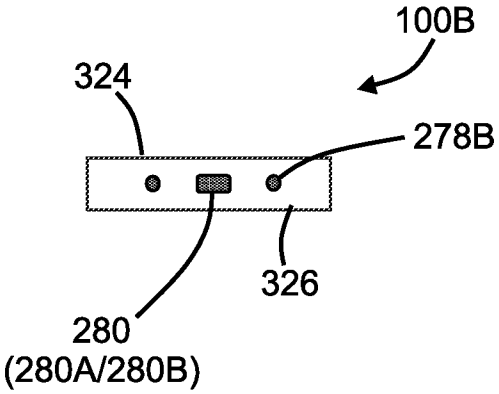
FIG. 20 is an end view of the second end of the example tile leveling tool 200B.
Figure 21:
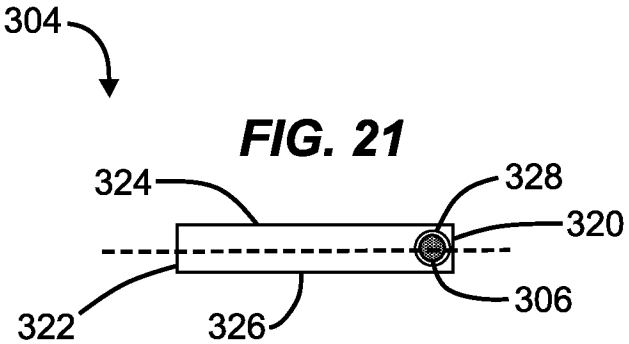
FIG. 21 is a perspective view of one configuration of an example adjustable spacer 300 of the tile leveling tool 200B.
Figure 22:
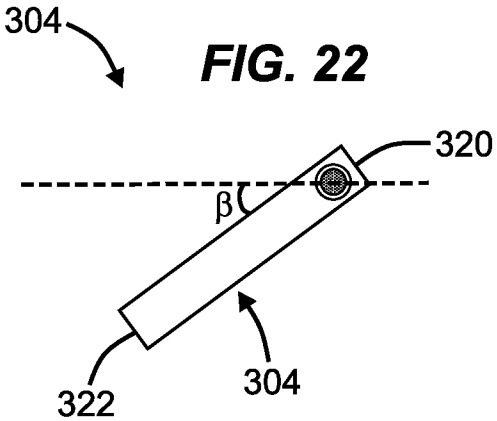
FIG. 22 is a perspective view of another configuration of the example adjustable spacer of FIG. 21.
Figure 23:
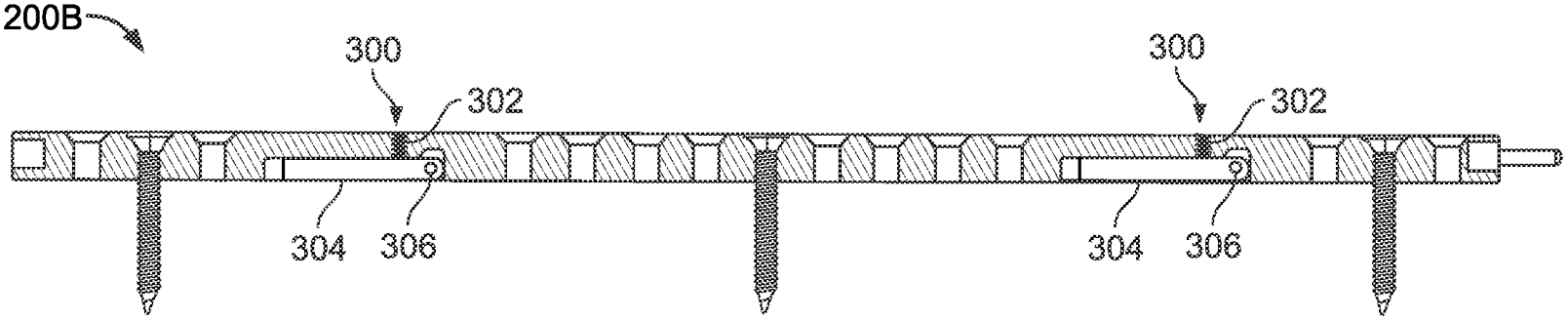
FIG. 23 is a cross-sectional view of one configuration of the example tile leveling tool 200B.
Figure 24:
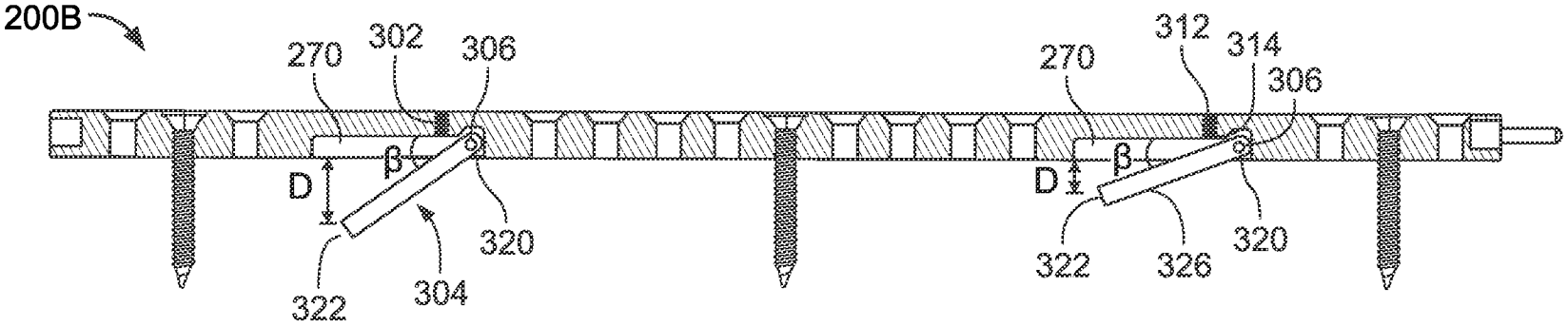
FIG. 24 is a cross-sectional view of another configuration of the example tile leveling tool 200B.

FIGS. 15-24 illustrate tool 200B as another example of the tool 200. FIG. 15 is an exploded view of the tool 200B. FIG. 16 is a perspective view of the assembled tool 200B. FIG. 17 is a front view of the assembled tool 200B. FIG. 18 is a bottom view of the assembled tool 200B. FIG. 19 is an end view of one end of the tool 200B. FIG. 20 is an end view of another end of the tool 200B. FIGS. 21-22 illustrate various configurations of an example adjustable spacer 300 of the tool 200B. FIGS. 23-24 are cross-sectional views of the tool 200B.

As illustrated in the example, the tool 200B includes a main body 202 and at least one adjustable spacer 300. Similar to the tool 200A, the tool 200B may be composed of various individual components that can be separated apart (FIG. 15). The various components can be assembled to form an integrated tool 200B (FIG. 16) that is ready to use. In some embodiments, the tool 200B further include at least one anchor 272, at least one interlocking element 278, at least one attracting element 280, or any combinations thereof. The tool 200A is consistent with the tool 200B with respect to the main body 202, the anchor 272, the interlocking element 278, and the attracting element 280. To avoid undue repetition, the description of various aspects of the main body 202, the anchor 272, the interlocking element 278, and the attracting element 280 will not be separately repeated herein.

In the illustrated example, the adjustable spacer 300 of the tool 200B includes a set screw 302, a leveling pad 304, and an axle pin 306. The set screw 302 and the leveling pad 304 can be separated apart. The set screw 302 extends from a front end 312 to a rear end 314. The set screw 302 has a length that is less than the height (H) of the main body 202. The set screw 302 is configured to be removably threaded into the main body 202 through a threaded aperture 262 thereof. The threaded aperture 262 may be pre-existing and compatible with the set screw 302 in size and orientation. Alternatively, the threaded aperture 262 may be generated in situ when the set screw 302 is threaded into the main body 202.

In one possible configuration as shown in FIGS. 23-24, the front end 312 of the set screw 302 is not extended out of the front side 232, and the rear end 314 is not extended out of the rear side 234. Upon actuation, the set screw 302 is threadedly movable in both a frontward and a rearward direction along the height (H) of the main body 202.

In the illustrated example, the leveling pad 304 has a relatively thin and substantially flat configuration. The leveling pad 304 includes a proximal edge 320, a distal edge 322, a front surface 324, a rear surface 326, and an opening 328. The opening 328 is proximate the proximal edge 320, between the front surface 324 and the rear surface 326, and through the leveling pad 304. The opening 328 substantially aligned with the proximal edge 320 and is configured to accommodate the axle pin 306.

The axle pin 306 is configured to be mounted on the rear side 234 of the main body 202 along the width (W) thereof. In one possible configuration, the axle pin 306 is inserted into the leveling pad 304 through the opening 328 and mounted on the rear side 234 proximate the rear end 314 of the set screw 302.

In some embodiments, the main body 202 includes a recess 270 as described above. The recess 270 is configured to accommodate the leveling pad 304 and the axle pin 306. In one possible configuration, the leveling pad 304 can entirely reside in the recess 270 such that the leveling pad 304 does not extend out of the rear side 234.

In the illustrated example, the leveling pad 304 is configured to move pivotally about the axle pin 306 by an angle (β). The angle (β) can be in a range from about 0 to about 90 degrees, or from about 0 to about 60 degrees, or from about 0 to about 45 degrees, or from about 0 to about 30 degrees. In operation, an installer can move the set screw 302 rearwardly to cause the rear end 314 of the set screw 302 to contact and push the leveling pad 304 at a point proximate the axle pin 306 and to simultaneously cause the distal edge 322 to move rearwardly away from the rear side 234 by a distance (D) from about 0 to about 1 inch, or from about 0 to about 0.8 inch, or from about 0 to about 0.6 inch, or from about 0 to about 0.5 inch.

Figure 25:
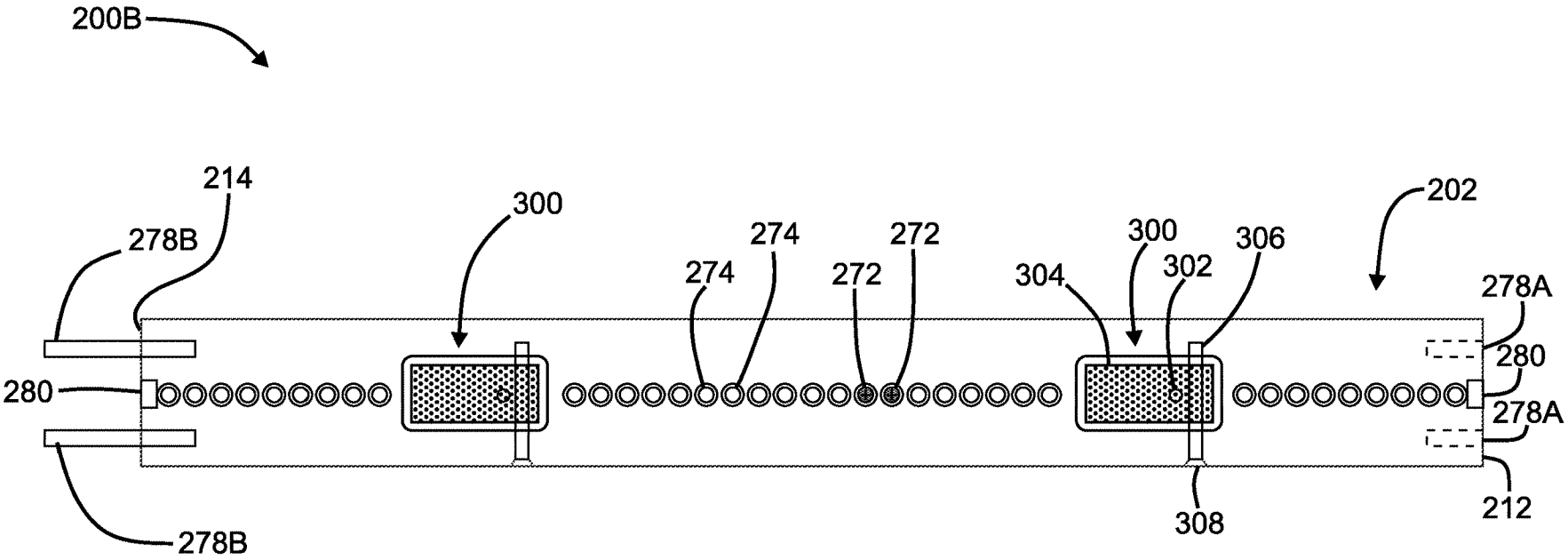
FIG. 25 is a top view of a variation of the example tile leveling tool 200B.
Figure 26:
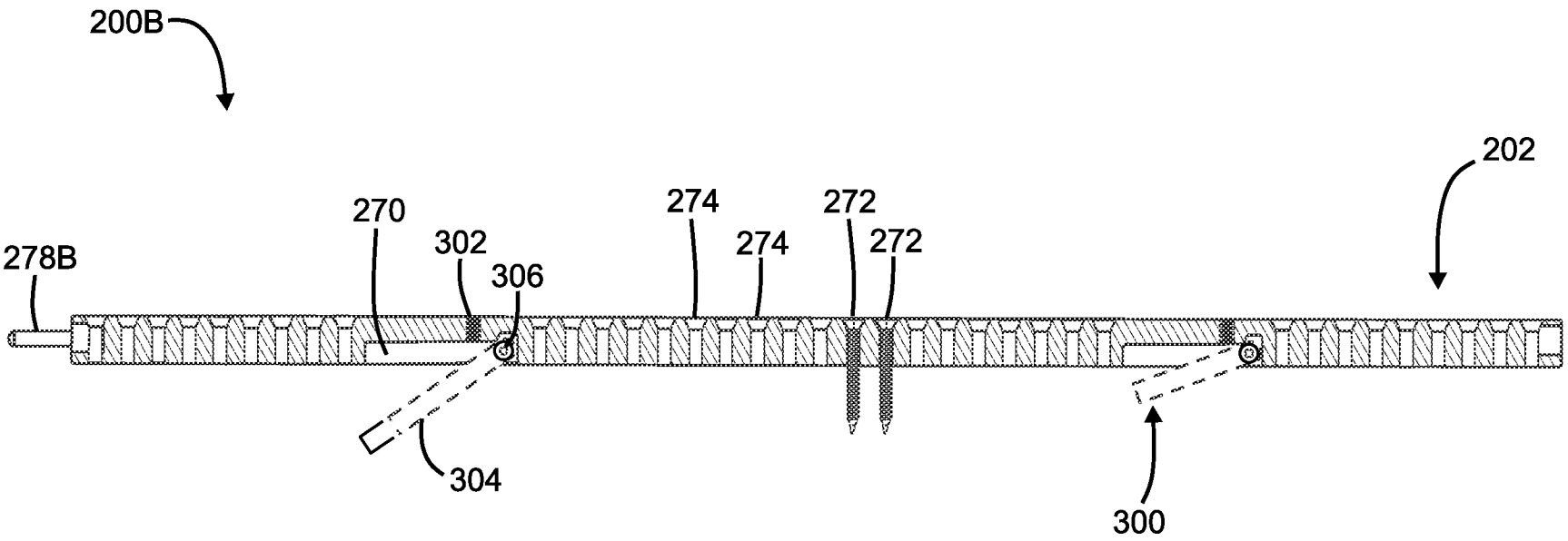
FIG. 26 is a cross-sectional view of the variation of the example tile leveling tool 200B according to FIG. 25.

FIGS. 25-26 illustrate a variation embodiment of the example tile leveling tool 200B. FIG. 25 is top view of the variation embodiment of tool 200B. FIG. 16 is a perspective view of the variation embodiment of the tool 200B. In the illustrated embodiment, the tile leveling tool 200B includes a main body 202, at least one adjustable spacer 300, a plurality of anchors 272, an interlocking element 278, and an attracting element 280. Various aspects of the main body 202, the adjustable spacer 300, the anchors 272, the interlocking element 278, and the attracting element 280 are generally consistent with the previous description regarding tool 200A of FIGS. 4-14 and the tool 200B of FIGS. 15-24.

In the illustrated embodiment, the main body 202 of the tile leveling tool 200B has a rectangular cuboid configuration and has a length (L) of about 24 inches, a width (W) of about 2 inches, and a height (H) of about 0.75 inch. The main body 202 comprises a plurality of threaded apertures 274 along the longitudinal axis 216 of the main body 202. The threaded apertures 274 are compatible in size with the anchor 272.

The adjustable spacer 300 includes a set screw 302, a leveling pad 304, and a axle pin 306. The leveling pad 304 has rectangular and relatively thin configuration. The leveling pad 304 has a length of about 2 inches, a width of about 0.75 inch, and a thickness of about 0.5 inch.

The main body 202 further comprises a recess 270 configured to accommodate the leveling pad 304. The recess 270 has a slightly larger dimension than that of the leveling pad 304, with a length of about 2.25 inches, a width of about 0.875 inch, and a thickness of about 0.5 inch.

The leveling pad 304 is pivotally connected to the axle pin 306. The axle 306 is mounted on the main body 202 such that the leveling pad is capable of residing in the recess 270 in one configuration and pivotal about the axle pin 306. The axle 306 further comprises a flat head 308 that can be used as a hinge.

The interlocking element 278 includes a female end 278A and a male end 278B. The female end 278A includes two insert holes located on the first end 212. The male end 278B includes two insert pins placed on the second end 214. The two insert pins 278B protrude from the second end 214 and have a distance of about 1.25 inches between each other.

The attracting element 280 includes a pair of magnets 280A that are respectively placed on the first end 212 and 214 between the two insert holes or between the two insert pins.

Figure 27:
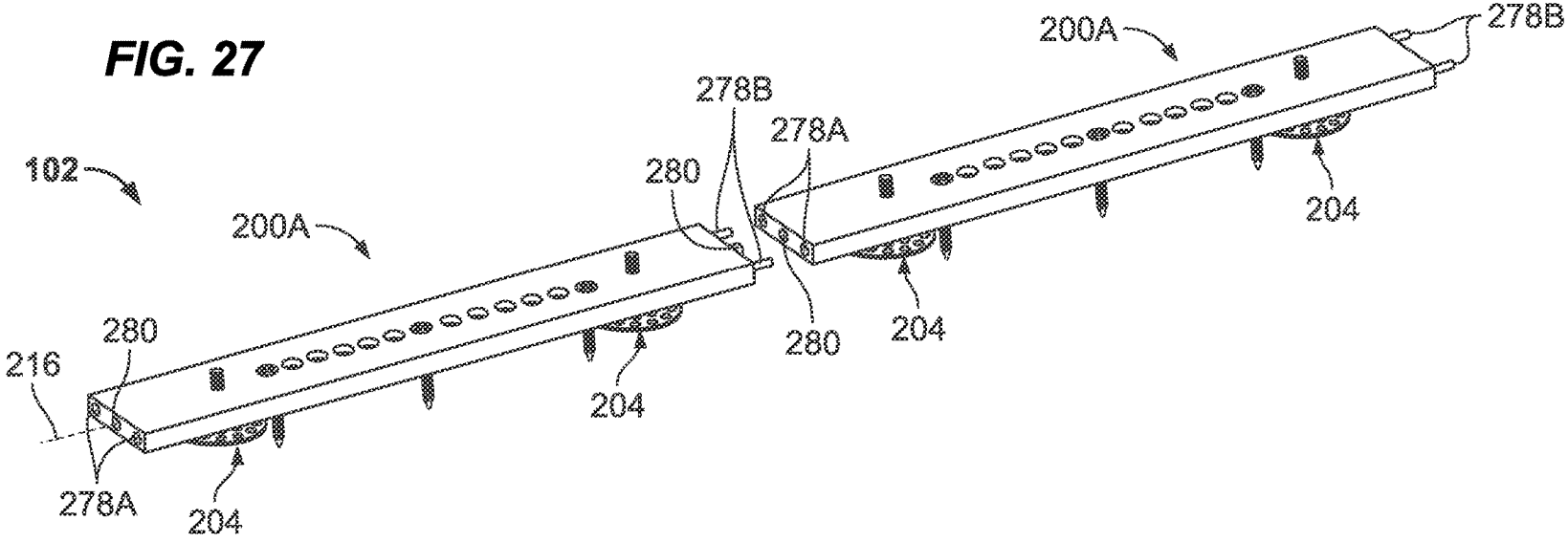
FIG. 27 is an explode view of one example of the track 102, wherein the track 102 includes 2 tile leveling tools 200A.
Figure 28:
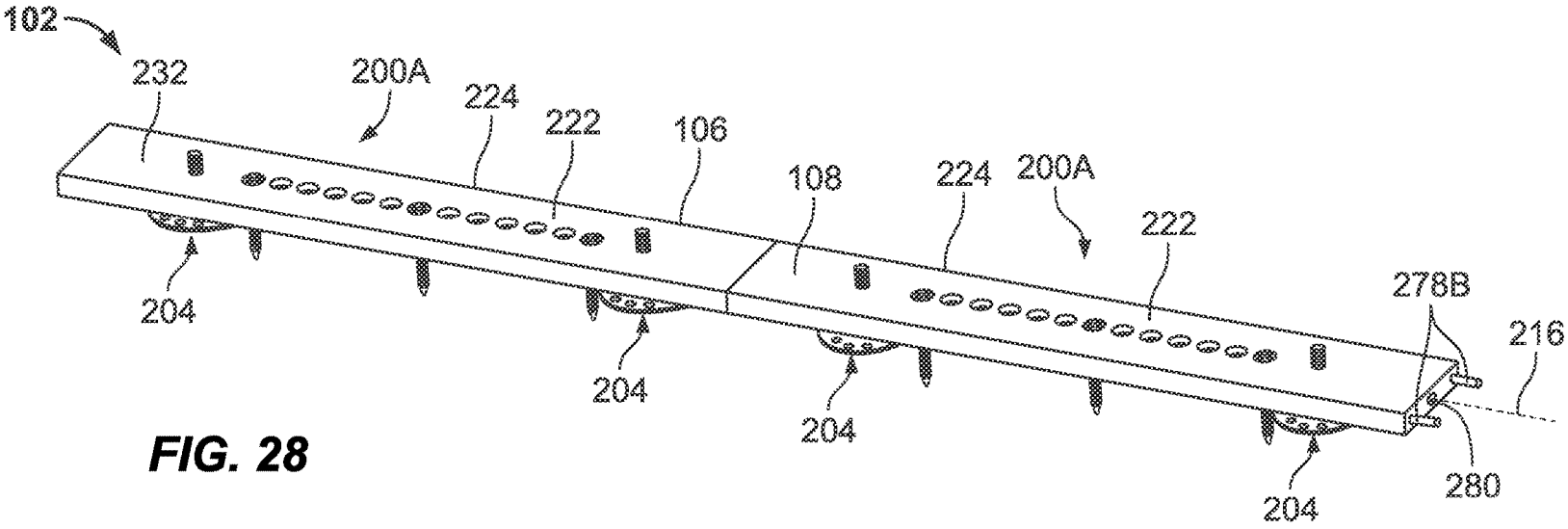
FIG. 28 is a perspective view of the assembled track 102 of FIG. 25.
Figure 29:
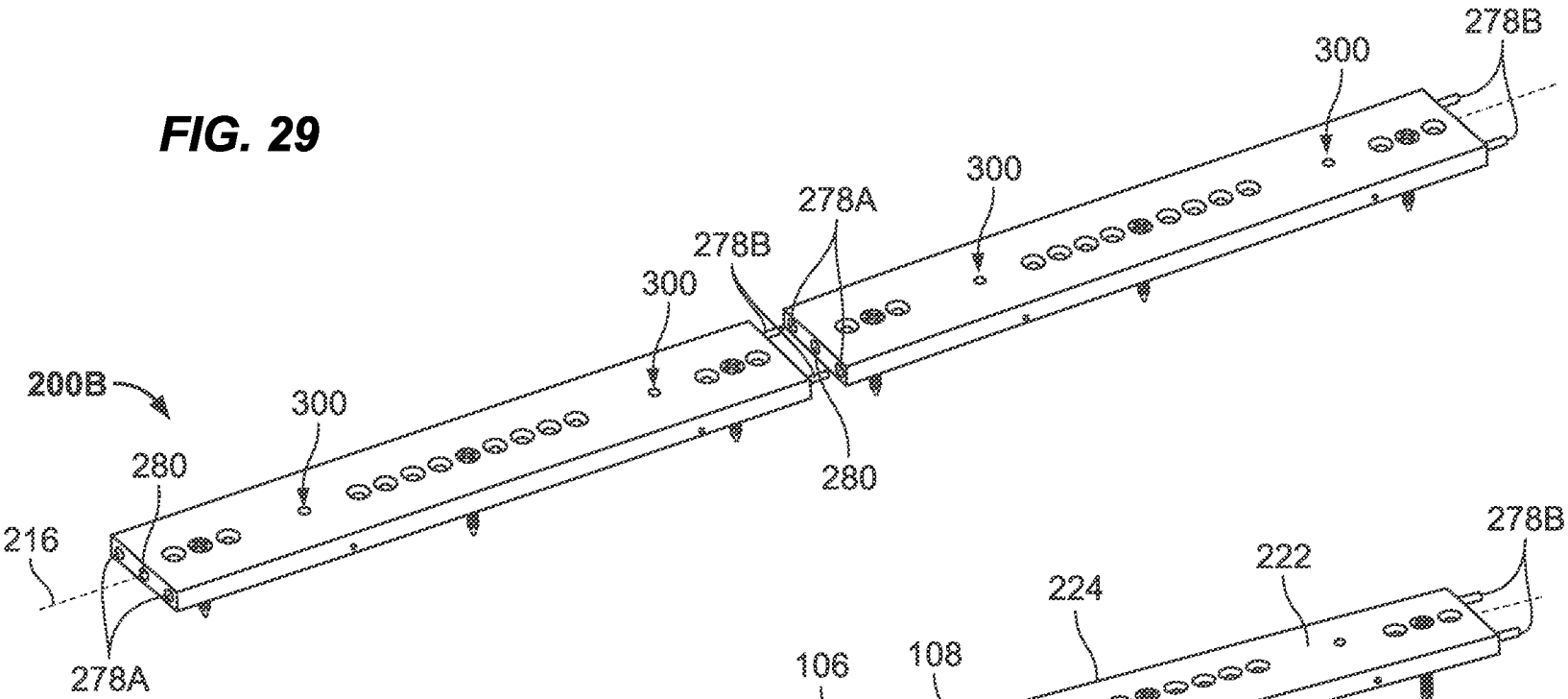
FIG. 29 is an explode view of another example of the track 102, wherein the track 102 includes 2 tile leveling tools 200B.
Figure 30:
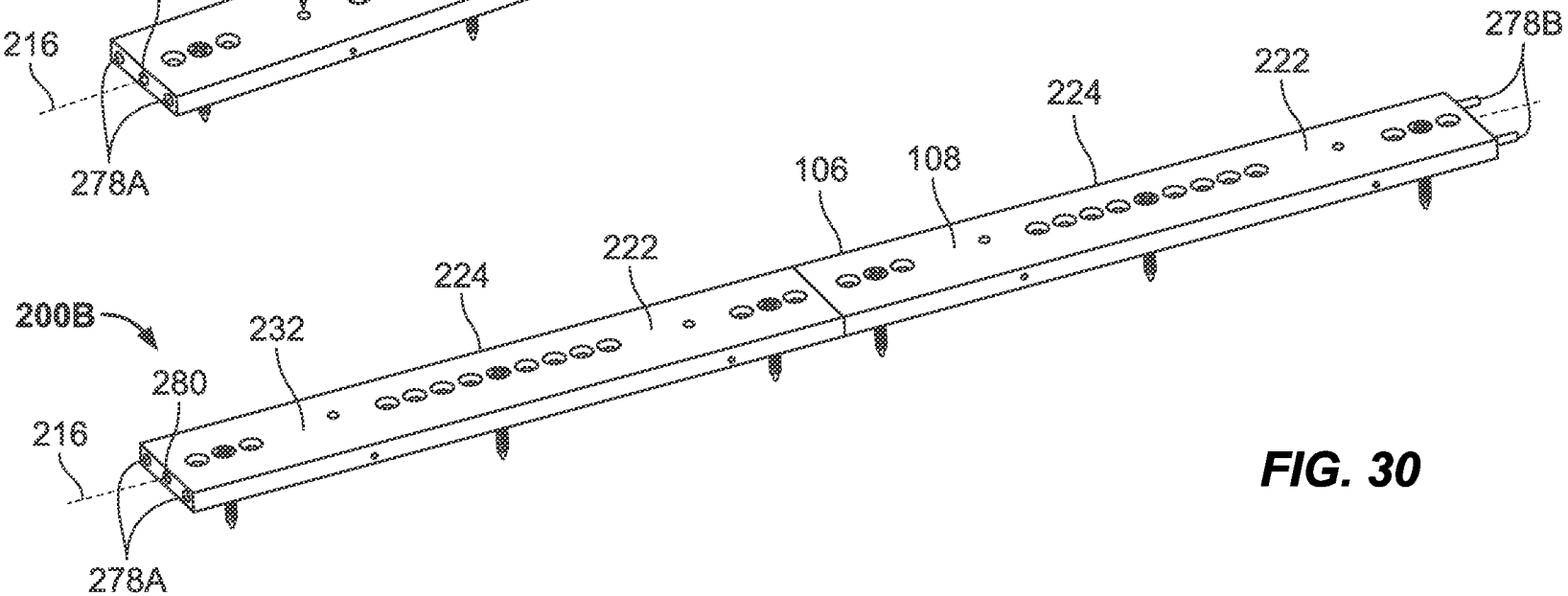
FIG. 30 is a perspective view of the assembled track 102 of FIG. 27.

Now referring to FIGS. 27-30, exemplary examples of the track 102 are illustrated and described. FIG. 27 is an explode view of one example of the track 102, wherein the track 102 includes 2 tools 200A. FIG. 28 is a perspective view of the assembled track 102 of FIG. 27. FIG. 29 is an explode view of another example of the track 102, wherein the track 102 includes 2 tools 200B. FIG. 30 is a perspective view of the assembled track 102 of FIG. 29.

In the illustrated examples, the track 102 includes two tools 200, at least one extended reference side 108, and at least one extended reference edge 106. The two tools 200 can be either two tools 200A (FIGS. 27-28) or two tools 200B (FIGS. 29-30). The two tools 200 are configured to be connected and interlocked end-to-end by the interlocking elements 278 along the longitudinal axis 216. In particular, the female end 278A of one tool 200 is configured to mate with the corresponding male end 278B of the other tool 200 to form the track 102. In some embodiments, the attracting elements 280 of the two tools may be present to and coordinately improve the interlocking strength of the track 102.

In the illustrated examples, the extended reference side 108 includes the two corresponding reference sides 222 with respect to the two connected tools 200. Similarly, the extended reference edge 106 includes the two corresponding reference edges 224 with respect to the two connected tools 200.

It is noted that the track 102 of FIGS. 27-28 includes two tools 200A, and the threaded bolt 252 of each tool 200A extends out of the front side 232. Differently, the track 102 of FIGS. 29-30 includes two tools 200B, and the set screw 302 of each tool 200B does not extend out of the front side 232, which allows the reference side 222 to be continuous along the longitudinal axis 216.

In some embodiments, the track 102 may include a number of tools 200, wherein the number is greater than 2. For example, the number can be at least 3, at least 4, at least 5, at least 6, at least 8, or at least 10, or at least 15, or at least 20. The track 102 advantageously allows an installer to build the length of reference sides and edges that are needed for an installation surface in any size and allows the tools to be reusable for tile installation.

Figure 31:
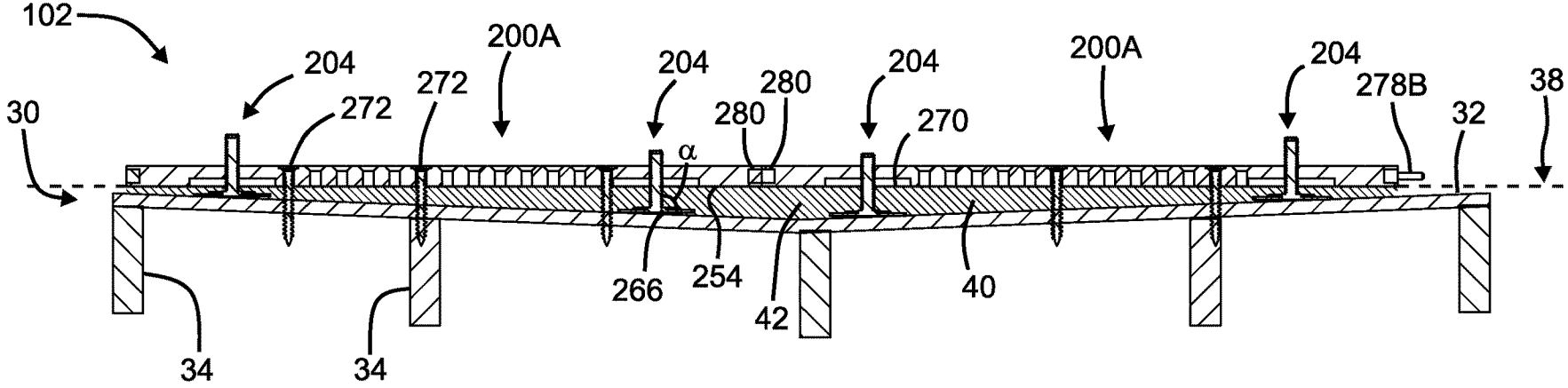
FIG. 31 is a cross-sectional view of one example track 102 placed on an uneven installation surface.
Figure 32:
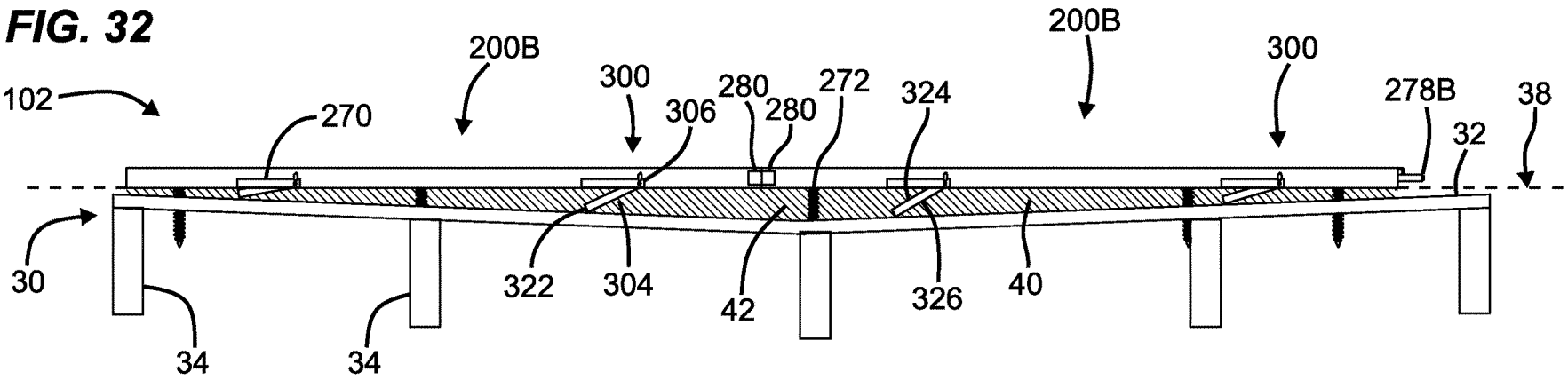
FIG. 32 is a cross-sectional view of another example track 102 placed on an uneven installation surface.

Now referring to FIGS. 31-32, exemplary examples of the track 102 placed on an installation surface will be illustrated and described. FIG. 31 is a cross-sectional view one example track 102 placed on an installation surface 30. FIG. 32 is a cross-sectional view of another example track 102 placed on an installation surface 30. In the illustrated examples, the track 102 can be two connected tools 200A (FIG. 31) or two connected tools 200B (FIG. 32). The track 102 is anchored on an uneven installation surface 30 by the anchors 272. The anchors 272 may be anchored into the stud wall 32 and/or the stud 34.

In the illustrated example of FIG. 31, the track 102 includes two tools 200A. The adjustable spacer 204 is configured to adjust a space between the rear side 234 of the tool 200A and the installation surface 30. In particular, the threaded bolt 252 can be adjusted to allow the rear surface 266 of the leveling pad 254 to engage with the installation surface 30. Multiple adjustable spacers 204 can be adjusted coordinately to determine a desired level and position of the track 102 relative to the installation surface.

In the illustrated example of FIG. 32, the track 102 includes two tools 200B. The adjustable spacer 300 is configured to adjust a space 42 between the rear side 234 of the tool 200B and the installation surface 30. In particular, the set screw 302 can be adjusted to allow the distal edge 322 of the leveling pad 304 to engage with the installation surface 30. Multiple adjustable spacers 300 can be adjusted coordinately to determine a desired level and position of the track 102 relative to the installation surface.

In the illustrated examples of FIGS. 31-32, the leveled track 102 anchored on the installation surface 30 provides at least one extended reference edge 106 that is sufficient long to cross the entire installation surface 30. The leveled track 102 provides an extended reference side 108 that is coplanar with a level plane 38. The extended reference side 108 can be used to level and align tiles in the level plane 38. An installer can dispose an appropriate amount of mortar or cement 40 in the space 42 between the level plane 38 and the installation surface 30 such that the tiles 20 are leveled and aligned in the level plane 38.

Figure 33:
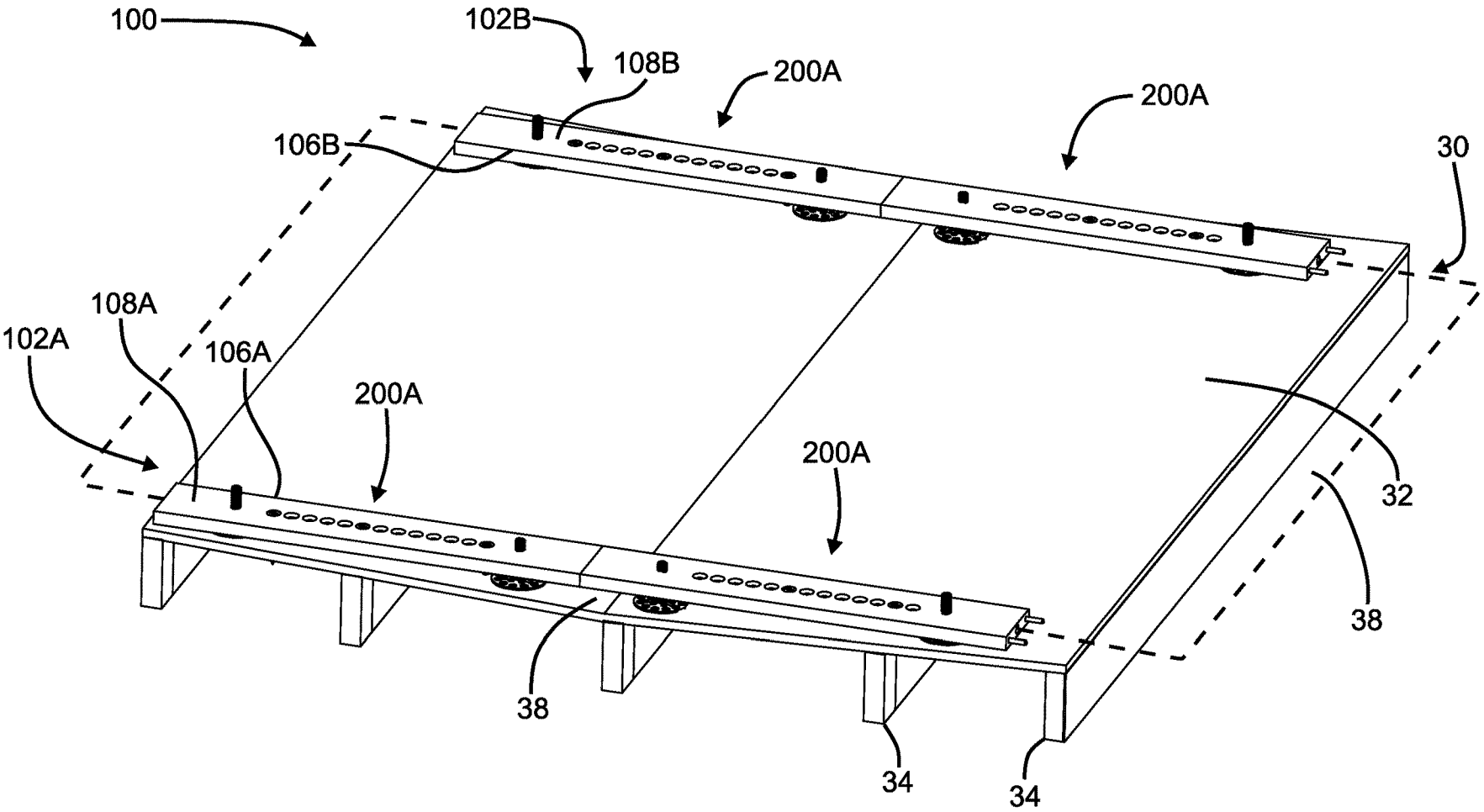
FIG. 33 is a perspective view of one example of the tile leveling system 100.

Now referring to FIGS. 33-37, exemplary examples of the tile leveling system 100 are illustrated and described. FIG. 33 is a perspective view of one example of the tile leveling system 100. In the illustrated example, the tile leveling system 100 includes two tracks 102A and 102 B. The two tracks 102A and 102B are anchored on an uneven installation surface 30 and are parallel to each other. The track 102A includes an extended reference edge 106A and an extended reference side 108A. The track 102B includes an extended reference edge 106B and an extended reference side 108B. The two parallel tracks 102A and 102B define an installation area therebetween, and the extended reference sides 108A and 108B and the extended reference edges 106A and 106B provide a guide for an installer to arrange tiles to be installed in the installation area.

Figure 34:
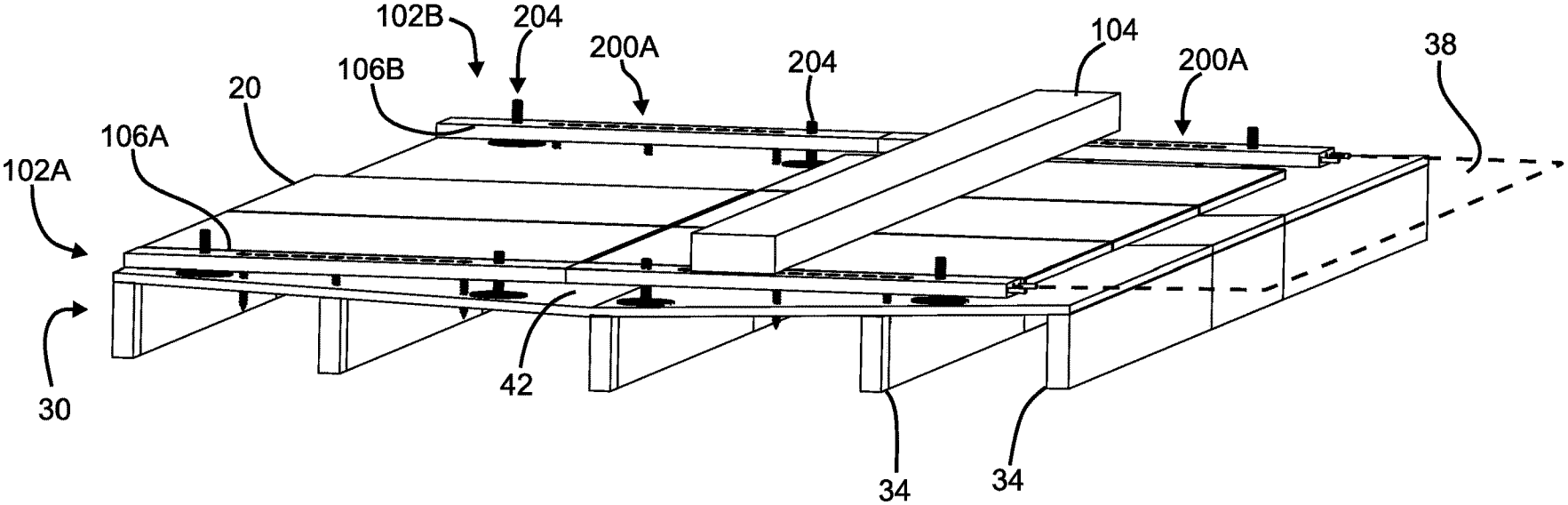
FIG. 34 is a top perspective view of another example tile leveling system 100.
Figure 35:
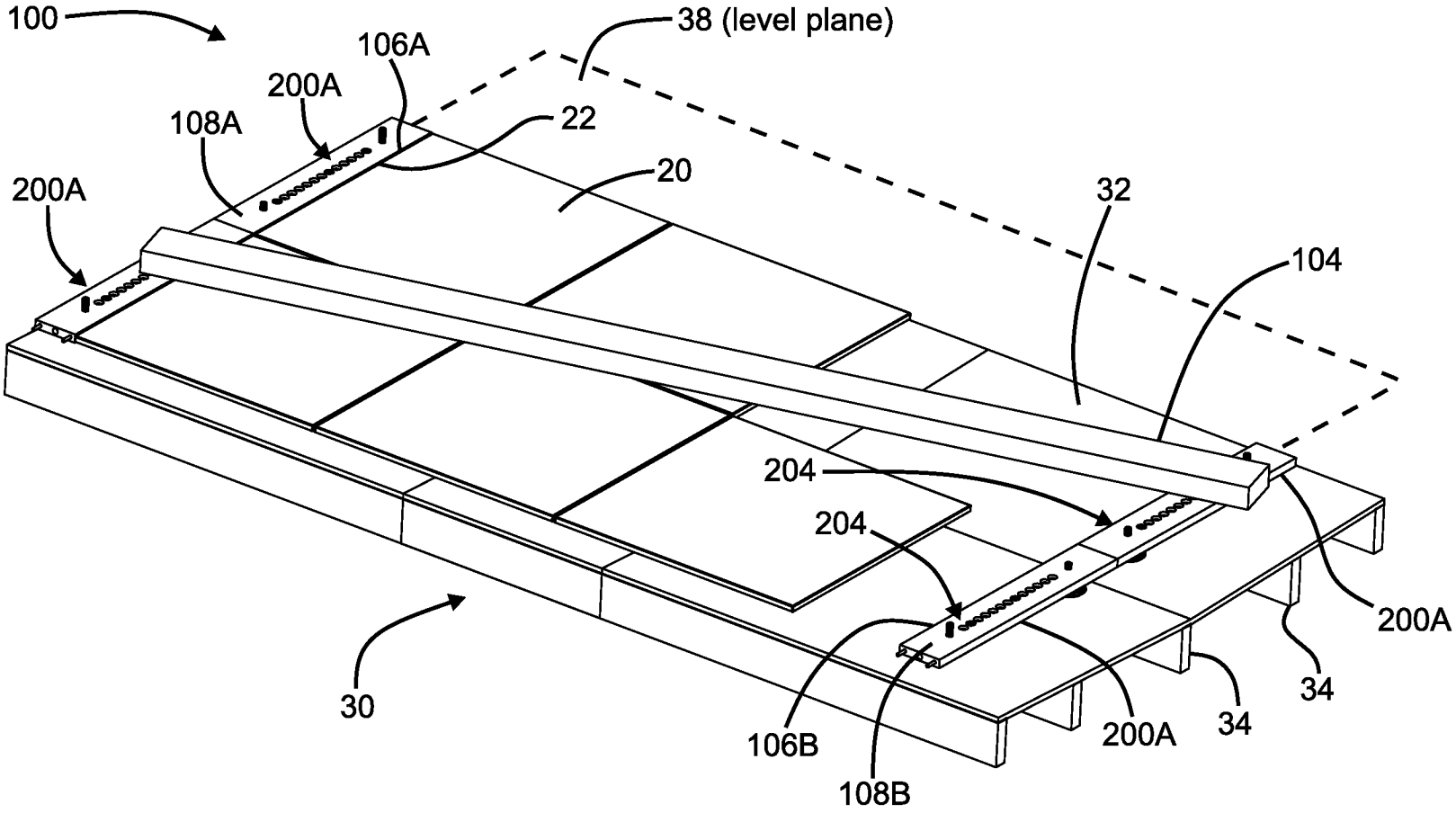
FIG. 35 is a front perspective view of the example tile leveling system 100 of FIG. 32.

FIGS. 34-35 illustrate another example tile leveling system. FIG. 34 is a top perspective view of the example tile leveling system 100. FIG. 35 is a front perspective view of the example tile leveling system 100 of FIG. 32.

In the illustrated example, the tile leveling system 100 includes two tracks 102 (102A and 102B), and a sliding tool 104. Each of the tracks 102 includes two interlocked tools 200A. The two tracks 102 are anchored on an uneven installation surface 30 and are parallel to each other. The adjustable spacers 204 of the tracks 102 are configured to adjust the space 42 between the tracks 102 and the uneven installation surface 30 and adjust the tracks 102 to the level plane 38. The two tracks 102 provide extended reference edge 106A and 106B and extended reference sides 108A and 108B. The tile leveling system 100 provides a guide for an installer to align tile edges 22 along with the extended reference edges 106A and 106B. In some embodiments, the tile edges 22 can be aligned with at least a part of the extended reference edge 106A. In some embodiments, a series of spacers can be disposed between the tile edges 22 and the extended reference edge 106A to set a desired space between the tile edges 22 and the extended reference edge 106A. The tile leveling system 100 also provides the level plane 38 that is defined by the extended reference sides 108A and 108B, which can be used as a guide for the tiles 20 to be leveled and aligned in the level plane 38.

In the illustrated example, the sliding tool 104 is configured to be slid over the extended reference sides 108A and 108B of the two tracks 102 and the tiles 20. The sliding tool 104 is further configured to tamp down on the tiles 20 when sliding over the tiles 20 to compress the mortar or cement 40 disposed in the space 42 and to cause the tiles 20 be to leveled co-planar with the extended reference sides 108A and 108B. If tiles 20 are arranged and tamped down too much by the sliding tool 104, then the tiles 20 may be removed and more mortar or cement 40 is disposed in the space 42 to allow the tiles 20 be re-arranged by the tile leveling system 100.

Figure 36:
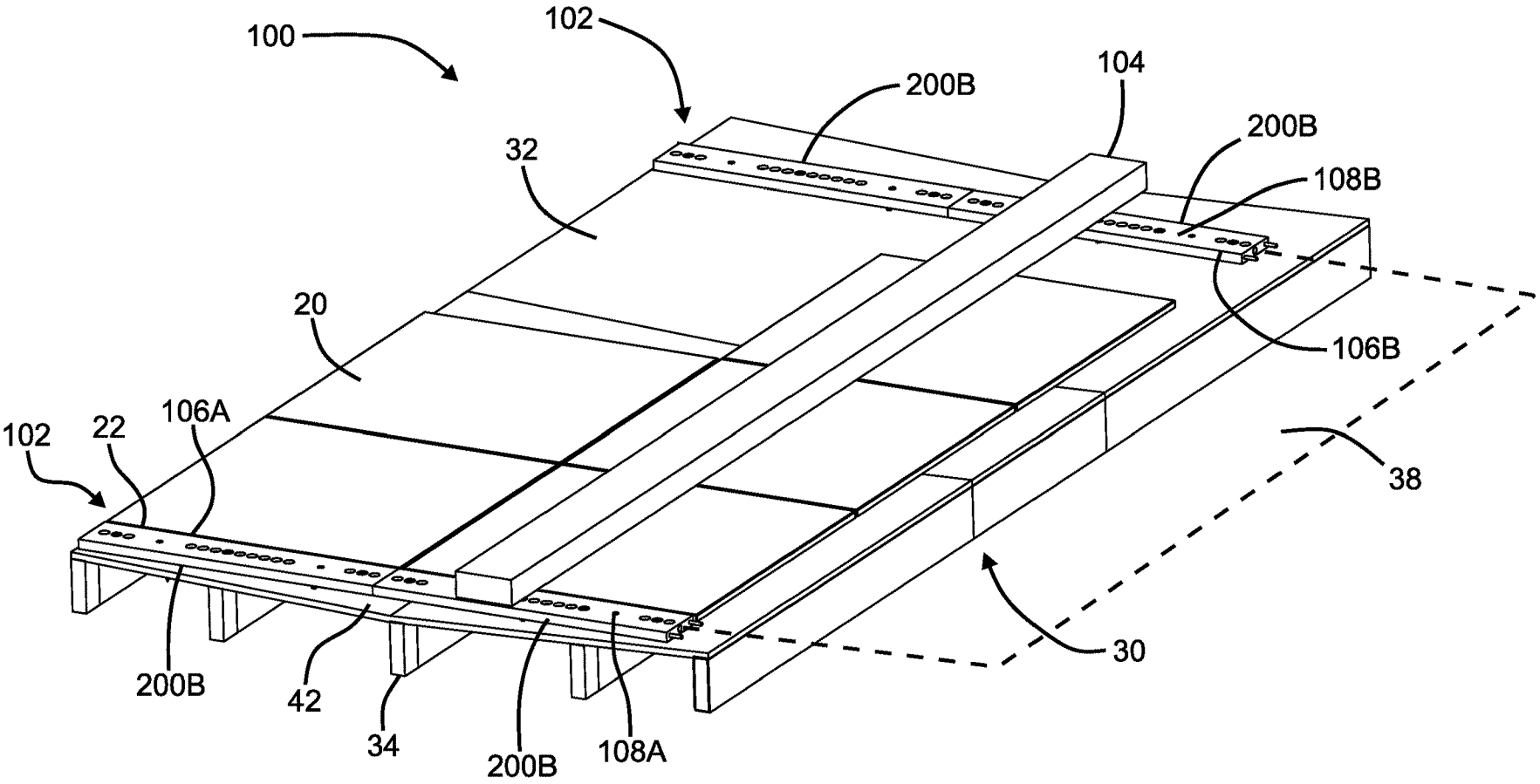
FIG. 36 is a perspective view of yet another example tile leveling system 100.
Figure 37:
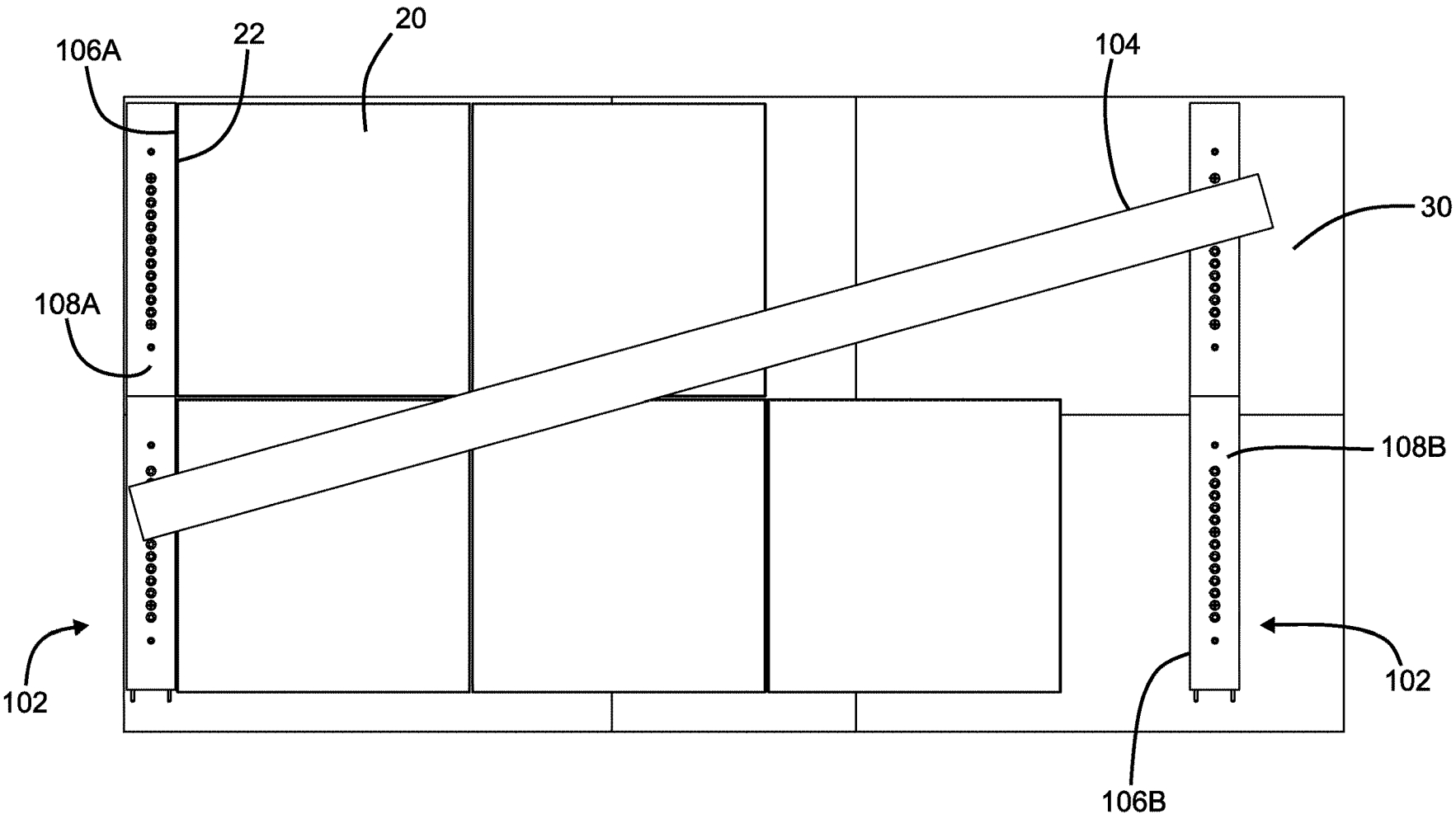
FIG. 37 is a front view of the example tile leveling system 100 of FIG. 34.

FIGS. 36-37 illustrate yet another example tile leveling system. FIG. 36 is a perspective view of the example tile leveling system 100. FIG. 37 is a front view of the example tile leveling system 100. In the illustrated example, the tile leveling system 100 includes two tracks 102 (102A and 102B), and a sliding tool 104. Each of the tracks 102 includes two interlocked tools 200B. Similar to the example tile leveling system of FIGS. 34-35, the two tracks 102 are anchored on an uneven installation surface 30 and are positioned to be parallel to each other. The adjustable spacers 300 of the tracks 102 are configured to adjust the space 42 between the tracks 102 and the uneven installation surface such that the extended reference sides 108A and 108B are in line with the level plane 38. Similar to the example of FIGS. 34-35, the extended reference edges 106A and 106B and the extended reference sides 108A and 108B can be used as a guide for the tiles 20 to be leveled and aligned in the level plane 38.

In the illustrated example of FIGS. 36-37, the adjustable spacer 300 includes a set screw 302 that is not extended out of the front side of the tool 200B. As discussed above, the extended reference sides 108A and 108B are thus continuous, and the sliding tool 104 can be slid over both the tiles 20 and the extended reference sides 108A and 108B continuously across the entire installation surface 30 without obstruction.

Figure 38:
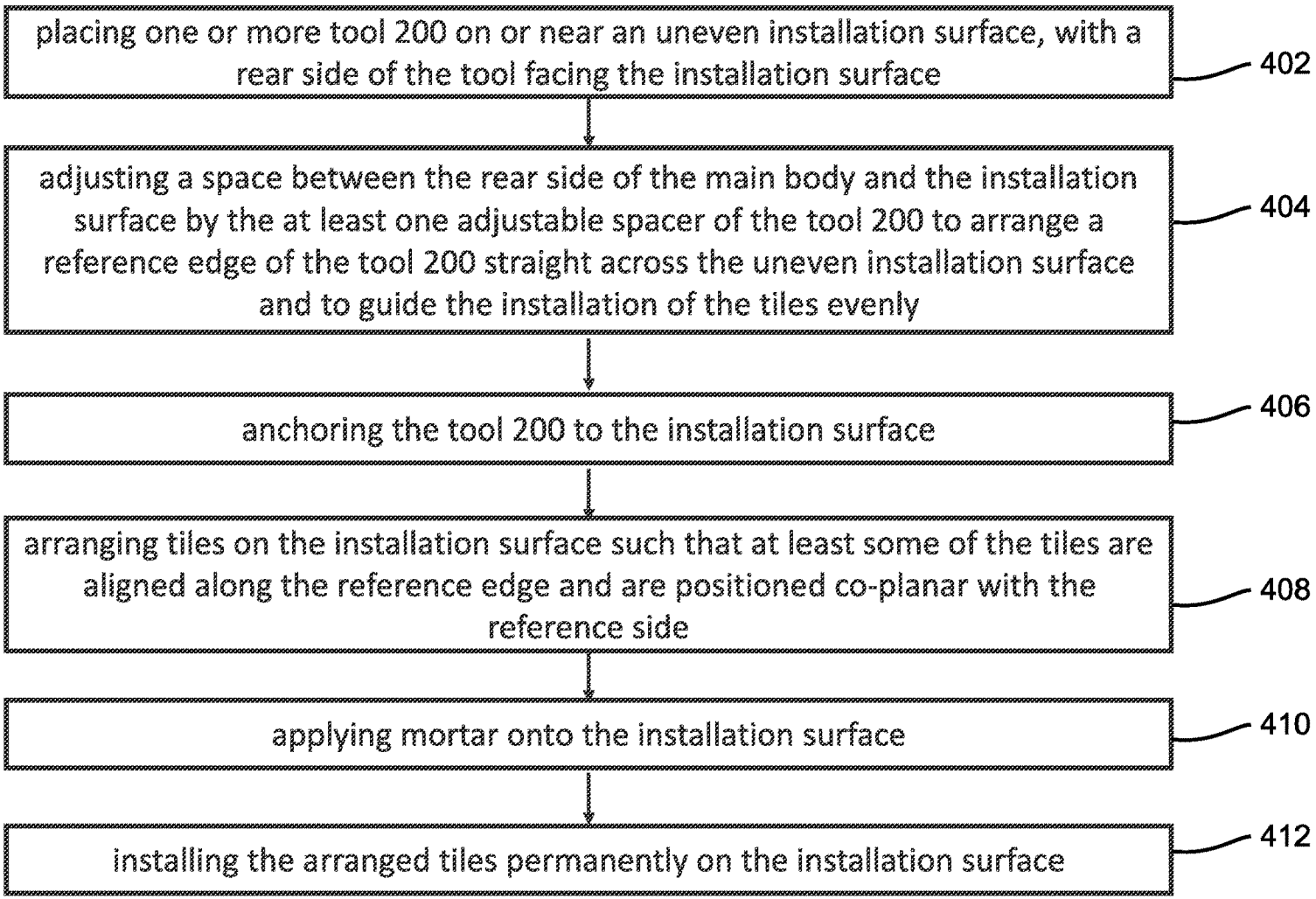
FIG. 38 is a block diagram of one example method 400 for leveling and aligning tiles.
Figure 39:
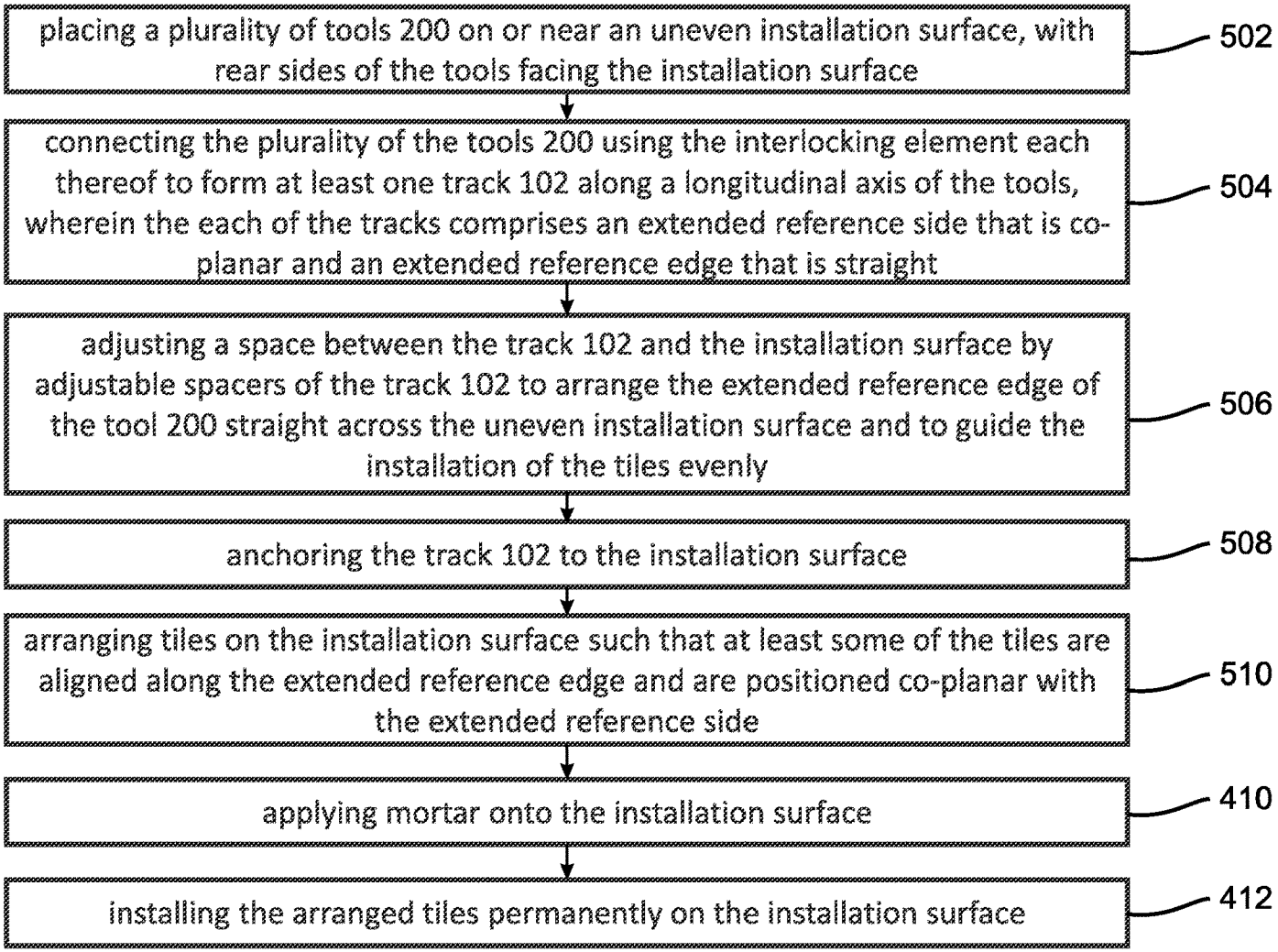
FIG. 39 is a block diagram of another example method 500 for leveling and aligning tiles.
Figure 40:
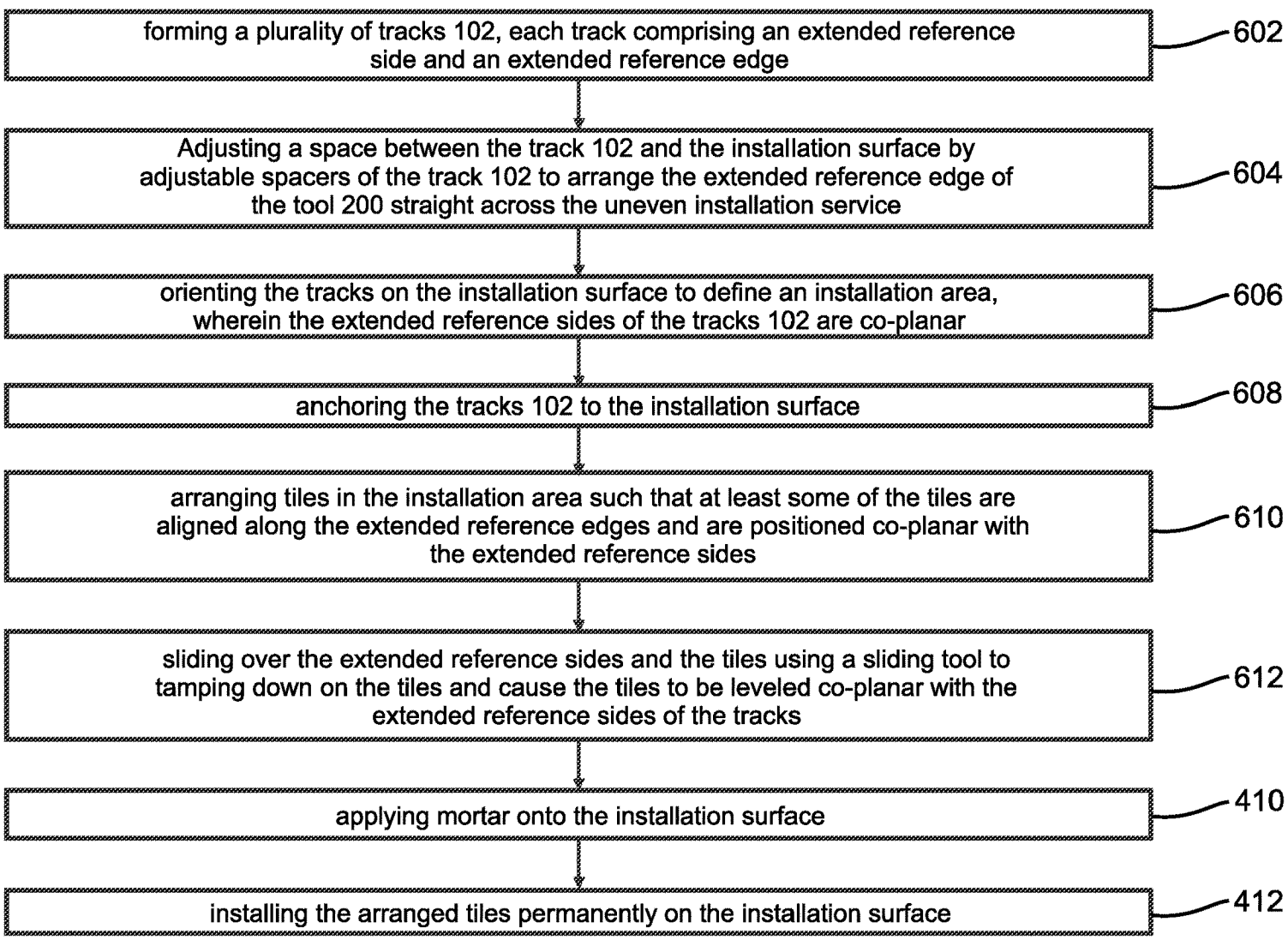
FIG. 40 is a block diagram of yet another example method 800 for leveling and aligning tiles.

Now referring to FIGS. 38-40, exemplary examples of a method for leveling and aligning tiles are illustrated and described. FIG. 38 is a block diagram of one example method 400 for leveling and aligning tiles. In the illustrated example, a method 400 for leveling and aligning tiles includes operations 402, 404, 406, and 408. Operation 402 includes placing one or more tool 200 (200A or 200B) on or near an uneven installation surface 30. The tool 200 is placed on or near the uneven installation surface 30 with a rear side 234 of the tool 200 facing the installation surface 30. Operation 404 includes adjusting a space 42 between the rear side 234 of the tool 200 and the installation surface 30 by at least one adjustable spacer 204 (of the tool 200A) or at least one adjustable spacer 300 (of the tool 200B) to arrange a reference edge 224 of the tool 200 straight across the uneven installation surface 30 and to guide the installation of the tiles evenly. Operation 406 includes anchoring the tool 200 to the installation surface 30. Operation 406 may be performed by using an anchor 272 of the tool 200. Anchoring the tool 200 can be operated by hands or by an additional tool 40 such as a screw driver known in the art. Operation 408 includes arranging tiles 20 on the installation surface 30 such that at least some of the tiles 20 are aligned along the reference edge 224 and are positioned co-planar with a reference side 222 of the tool 200. At operation 408, tile spacers 40 can be disposed between tile edges 22 and the reference edge 224 to set a desired space between the tiles and the reference edge 224.

In some embodiments, the method 400 further includes operations 410 and 412. Operation 410 includes applying mortar or cement 40 onto the installation surface 30 to fill the space 42 between the between the rear side 234 of the tool 200 and the installation surface 30. The amount of the mortar may vary depending on level of deviation across the entire installation surface 30. If the tiles 20 are not aligned with the reference side 222, the tiles 20 can be re-arranged by adjusting the amount of mortar to an appropriate level that allows the tiles 20 to be aligned with the reference side 222. Operation 412 includes installing the arranged tiles 20 permanently on the installation surface 30. At operation 412, the tiles are leveled along the reference edge 224 and aligned with the reference side 222. The leveled and aligned tiles 20 are permanently installed on the installation surface 30 once the mortar disposed between the tiles 20 and the installation surface 30 is dried. The installed tiles that are leveled and aligned by the tool 200 provide a flat, even, and flawless tile surface that is leveled and co-planar with the level plane 38.

FIG. 39 is a block diagram of another example method 500 for leveling and aligning tiles. In the illustrated example, the method 500 for or leveling and aligning tiles includes operations 502, 504, 506, 508, and 510. Operation 506 includes placing a plurality of tools 200 (200A or 200B) on or near an uneven installation surface 30, with rear sides of the tools facing the installation surface 30. Operation 508 includes connecting the plurality of the tools 200 using an interlocking element 278 of each tool to form at least one track 102 along a longitudinal axis 216 of the tools 200. The formed tracks 102 each include an extended reference side 108 that is flat and an extended reference edge 106 that is straight along an longitudinal axis 216 of the track. The extended reference side 108 of the track is aligned with a level plane 38. Operation 506 includes adjusting a space between the track 102 and the installation surface by adjustable spacers 204 (for tool 200A) or 300 (for tool 200B) of the track 102 to arrange the extended reference edge 106 of the tool 200 straight across the uneven installation surface 30 and to guide the installation of the tiles evenly in the level plane 38. Similar to operation 406 described above, operation 508 includes anchoring the track 102 to the installation surface. Similar to operation 408, operation 510 includes arranging tiles 20 on the installation surface 30 such that at least some of the tiles 20 are aligned along the extended reference edge 106 and are positioned co-planar with the level plane 38. In some embodiments, the method 500 further includes operations 410 and 412 that are described above.

FIG. 40 is a block diagram of yet another example method 600 for leveling and aligning tiles. In the illustrated example, the method 600 for or leveling and aligning tiles includes operations 602, 604, 606, 608, and 610. Operation 602 includes forming a plurality of tracks 102 by connecting two or more tools 200 (200A or 200B) end-to-end using interlocking elements 278 of each tool. The formed tracks each comprises an extended reference side 108 and an extended reference edge 106. Operation 604 includes adjusting a space 42 between each track 102 and the installation surface 30 by adjustable spacers 204 (for tool 200A) or 300 (for tool 200B) of the track 102 to arrange the extended reference edge 106 of the tool 200 straight across the uneven installation surface. Operation 606 includes orienting the tracks on the installation surface to define an installation area. The tracks 102 are oriented such that the extended reference sides 108 of the tracks 102 are co-planar and determine a level plane 38. Operation 608 comprises anchoring the tracks 102 to the installation surface 30, similar to operation 508.

In some embodiments, the method 600 further includes operations 410, 612, and 412. Operation 410 includes applying mortar onto the installation surface 30. The mortar can fill the space between the track 102 and the installation surface 30. Operation 612 includes sliding over the extended reference sides 108 and the tiles 20 using a sliding tool to tamp down on the tiles 20. At operation 612, the mortar disposed in the space can be compressed by the sliding tool 104 to further level the tiles across the entire installation surface 30. The leveled tiles are co-planar with the level plane 38. Operation 412 includes installing the arranged tiles permanently on the installation surface that is described above.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A tool for guiding installation of tiles on an installation surface, the tool comprising:

an elongated main body extending along a longitudinal axis thereof, from a first end to a second end, the elongated main body comprising:

a front including a front reference surface that is flat;

a rear, opposite the front, which faces the installation surface during use;

a side including a side reference surface that is straight and extends between and is perpendicular to the front reference surface and parallel to the longitudinal axis; and a threaded aperture extending from the front to the rear of the elongated main body;

a leveling pad comprising a proximal end and a distal end, the proximal end is pivotally connected to the rear of the elongated main body, and the distal end is adjustably extendable out from the rear of the elongated main body; and a screw configured to move along the threaded aperture of the elongated main body to adjust the extension of the distal end of the leveling pad.

2. The tool of claim 1, further comprising:

an axle pin mounted on the rear of the elongated main body, wherein the axle pin is elongated along a width of the elongated main body; and wherein the leveling pad pivotably connects to the axle pin.

3. The tool of claim 1, further comprising:

one or more anchors configured to be inserted through the elongated main body from the front reference surface and into the installation surface to secure the elongated main body to the installation surface.

4. The tool of claim 1, wherein the elongated main body further comprises a recess configured to accommodate the leveling pad such that when the screw is retracted, the leveling pad can be recessed into the elongated main body.

5. The tool of claim 1, further comprising an interlocking element configured to removably connect the tool to a second tool along the longitudinal axis, wherein the connected tools form a track that provides an extended front reference surface that is co-planar across the connected tools, and an extended side reference surface that is straight across the connected tools.

6. The tool of claim 5, further comprising an attracting element arranged at the first and second ends of the elongated main body, wherein the attracting element is configured to attract a corresponding attracting element of the second tool.

7. The tool of claim 1, wherein the leveling pad has a rectangular shape.

8. The tool of claim 7, wherein the leveling pad has a length of about 2 inches, a width of about 0.75 inches, and a thickness of about 0.5 inches.

9. The tool of claim 1, further comprising a level indicator arranged in the elongated main body and visible from the front.

10. The tool of claim 2, wherein the distal end is configured to pivot about an axis corresponding to the axle pin, the axis being parallel to the installation surface.

11. The tool of claim 10, wherein the leveling pad pivots about the axis by an angle ranging from at least about 0 degrees to about 90 degrees.

12. A method for arranging tiles on an uneven installation surface using the tool of claim 1, the method comprising:

placing the tool on or near an uneven installation surface, with the rear of the tool facing the installation surface;

adjusting a space between the rear of the elongated main body and the installation surface by the leveling pad to arrange the front reference surface straight across the uneven installation surface and to guide the installation of the tiles evenly;

anchoring the tool to the installation surface; and arranging tiles on the installation surface such that at least some of the tiles are aligned along the side reference surface and are positioned co-planar with the front reference surface.

13. The method of claim 12, further comprising:

connecting a plurality of the tools using an interlocking element to form a track along the longitudinal axis, wherein the track comprises an extended front reference surface that is co-planar and an extended side reference surface that is straight;

wherein anchoring the tool to the installation surface comprises anchoring the track on the installation surface;

wherein arranging tiles on the installation surface comprises arranging tiles on the installation surface such that at least some of the tiles are aligned along the extended side reference surface and are positioned co-planar with the extended front reference surface.

14. The method of claim 12, further comprising:

forming a plurality of tracks, each track comprising an extended front reference surface and an extended side reference surface;

orienting the track on the installation surface to define an installation area, wherein the extended front reference surface of the plurality of tracks are co-planar;

wherein anchoring the track on the installation surface comprises anchoring the tracks on the installation surface; and wherein arranging tiles on the installation surface comprises arranging tiles in the installation area such that at least some of the tiles are aligned along the extended side reference surface of the plurality of tracks and are positioned co-planar with the extended front reference surface.

15. The method of claim 14, further comprising:

using a sliding tool to slide over the front reference surface of the tool secured on the installation surface and the tiles installed on the installation surface to cause the tiles to be leveled co-planar with the extended front reference surface of the tracks.

16. The method of claim 15, further comprising:

applying cement onto the installation surface; and installing the arranged tiles permanently on the installation surface.

17. A tool for guiding installation of tiles, the tool comprising:

an elongated main body extending along a longitudinal axis thereof, from a first end to a second end, the elongated main body comprising:

a front including a front reference surface that is flat;

a rear, opposite the front, which faces the installation surface during use; and a side including a side reference surface that is straight and extends between the front and the rear and is perpendicular to the front reference surface and parallel to the longitudinal axis; and a leveling pad comprising a proximal end and a distal end, the proximal end being pivotally connected to the rear of elongated main body, and wherein the distal end is configured to extend towards the installation surface while the tool is in use, and wherein the distal end is configured to pivot about an axis parallel to the installation surface.

18. The tool of claim 17, further comprising:

an axle pin mounted on the rear of the elongated main body, wherein the axle pin is elongated along a width of the elongated main body; and wherein the leveling pad is pivotably connected to the axle pin.

19. The tool of claim 17, further comprising:

one or more threaded apertures extending from the front to the rear of the elongated main body; and one or more anchors configured to be threaded through the one or more threaded apertures of the elongated main body from the front reference surface of the elongated main body into the installation surface to secure the elongated main body to the installation surface.

20. The tool of claim 17, wherein the elongated main body further comprises a recess configured to accommodate the leveling pad.

* * * * *